US012669129B2

(12) United States Patent
Fiedler

(10) Patent No.: US 12,669,129 B2
(45) Date of Patent: Jun. 30, 2026

(54) METHOD OF DETERMINING DELIVERY FLOW OR DELIVERY HEAD

(71) Applicant: Jens Olav Fiedler, Dortmund (DE)

(72) Inventor: Jens Olav Fiedler, Dortmund (DE)

(73) Assignee: WILO SE, Dortmund (DE)

( * ) Notice: Subject to any disclaimer, the term of this patent is extended or adjusted under 35 U.S.C. 154(b) by 549 days.

(21) Appl. No.: 17/972,750

(22) Filed: Oct. 25, 2022

(65) Prior Publication Data

US 2023/0193913 A1 Jun. 22, 2023

(30) Foreign Application Priority Data

Dec. 17, 2021 (LU) ..... 501040

(51) Int. Cl.
*F04D 27/00* (2006.01)
*F04D 13/06* (2006.01)

(52) U.S. Cl.
CPC ..... *F04D 27/001* (2013.01); *F04D 13/06* (2013.01)

(58) Field of Classification Search
None
See application file for complete search history.

(56) References Cited

U.S. PATENT DOCUMENTS

| | | | | |
|---|---|---|---|---|
| 10,184,476 | B2 * | 1/2019 | Sanders | F04D 15/0066 |
| 2017/0117563 | A1 | 4/2017 | Lee | |
| 2017/0184429 | A1 | 6/2017 | Kallesoe | |
| 2017/0321800 | A1 | 11/2017 | Ammler | |

FOREIGN PATENT DOCUMENTS

WO 1986006321 A1 11/1986

* cited by examiner

*Primary Examiner* — Matthew G Marini
(74) *Attorney, Agent, or Firm* — Lucas & Mercanti, LLP

(57) ABSTRACT

A torque required to achieve the modulated reference speed or adjustment of a modulated torque and the actual speed of the centrifugal pump is determined. Then a model speed is calculated with the aid of a mathematical pump-motor model simulating the behavior of the centrifugal pump within a hydraulic system as well as a disturbance signal from a deviation of the model speed from the actual speed of the centrifugal pump. Then a correction signal is determined by integrating the product of the disturbance signal and a sine or cosine signal with a multiple of the excitation frequency over at least one period of the excitation signal. Finally, at least one model parameter of the pump-motor model is determined as a function of the correction signal and the flow rate and/or the head is calculated using the adapted pump-motor model.

20 Claims, 8 Drawing Sheets

METHOD OF DETERMINING DELIVERY FLOW OR DELIVERY HEAD

FIELD OF THE INVENTION

The invention relates to a method of determining the delivery flow rate and/or the delivery head of a speed-controlled centrifugal pump assembly arranged in a hydraulic pipeline network from a system response of the pipeline network detectable in the centrifugal pump assembly to a periodic modulation of the rotational speed and/or torque of the centrifugal pump assembly.

Furthermore, the invention relates to a centrifugal pump assembly comprising a centrifugal pump, an electric motor driving it and control electronics for controlling the electric motor with or without feedback, the control electronics being set up to carry out the method.

BACKGROUND OF THE INVENTION

U.S. Pat. No. 10,184,476 describes how to stimulate a pipeline network by periodically modulating the setpoint rotational speed or torque of a centrifugal pump assembly arranged in the pipeline network to provoke a system response that in turn is reflected in an evaluable response of the centrifugal pump assembly, for example in the form of a change in the electrical power consumption or the torque required to maintain the (modulated) setpoint rotational speed. The system response (magnitude, shape, phase, latency) depends on the so-called "hydraulic inductance" of the pipeline network. From the response of the centrifugal pump assembly to this, it can determine its delivery flow rate.

Investigations have shown that this method requires a comparatively large modulation amplitude to obtain a sufficiently high signal-to-noise ratio in the desired signal to be evaluated and thus enable reliable determining the volume flow and/or the delivery head. In contrast, at a low modulation amplitude, the noise in the desired signal is comparatively high and thus worsens the accuracy of the volume flow determination. However, a large modulation amplitude leads to acoustic noise that is undesirable in pipeline networks such as central heating systems or cooling systems.

OBJECT OF THE INVENTION

The object of the present invention is to improve the method known in the prior art, in particular to reduce the noise in the desired signal despite a comparatively low excitation amplitude and at the same time to increase the accuracy of the determined delivery flow rate.

SUMMARY OF THE INVENTION

According to the invention, a periodic excitation signal of a specific excitation frequency is applied to a reference rotational speed or torque of the centrifugal pump assembly to obtain a modulated setpoint rotational speed, and then to perform the following steps:

a. Either determining and setting a torque required to achieve the modulated setpoint rotational speed, or setting the modulated torque,
b. determining the actual rotational speed of the centrifugal pump assembly,
c. calculating a model rotational speed with the aid of a mathematical pump-motor model simulating the behavior of the centrifugal pump assembly within a hydraulic pipeline network,
d. calculating at least one disturbance signal from a deviation of the model rotational speed from the actual rotational speed of the centrifugal pump assembly,
e. determining at least one correction signal by integrating the product of the disturbance signal and a sine or cosine signal having the single or a multiple of the excitation frequency over at least one period of the excitation signal,
f. adapting at least one model parameter of the pump-motor model as a function of the correction signal, and
g. calculating the delivery flow rate and/or the delivery head using the adapted pump-motor model.

Furthermore, a centrifugal pump assembly having a centrifugal pump, an electric motor driving it and control electronics for controlling, with or without feedback, the electric motor is proposed, the control electronics being set up to carry out the method according to the invention.

The above-described method has numerous advantages. First, it improves the accuracy of the delivery flow rate and/or delivery head determination by counteracting disturbing influences on the system formed by the centrifugal pump assembly and the connected hydraulic pipeline network, thereby reducing the noise in the determined delivery flow rate and/or delivery head signal. As a result, the signal requires less filtering, allowing a faster response of the centrifugal pump assembly to system condition changes or disturbances in the hydraulic pipeline network. Further, the periodic excitation signal may use a lower excitation amplitude than in the prior art, thereby reducing acoustic noise. As a result of the adaption of the model parameter(s) during operation of the pump, any modelling inaccuracies in the pump-motor model which may be due to a scattering of the model parameters in series production and/or to wear due to ageing, for example of the bearings of the centrifugal pump, are also compensated for.

By repeatedly adapting the model parameter(s), the pump-motor model is dynamic. This allows, among other things, to detect signs of ageing on the centrifugal pump assembly and to compensate for a resulting error in the pump-motor model that increases over time. In this way, the accuracy of the delivery flow rate and/or delivery head determination is kept constantly high over the entire operating time of the pump assembly. In addition, deposits on the impeller, e.g. of iron oxide, commonly known as "iron staining", can be detected, thus an early indication of the need for maintenance, especially of the overall system can be provided.

Suitably, the pump-motor model comprises at least a first equation enabling calculating the delivery flow rate and a second equation enabling calculating the model rotational speed. Suitably, these two equations are repeatedly evaluated cyclically. In terms of signals, this calculation can be performed in parallel.

For example, the first equation may be a volume flow equation in integral form. It is preferably based on a hydraulic differential equation that in particular describes a delivery head balance or pressure balance (delivery head and pressure are proportional) and that is transformed into the integral form to be able to calculate the delivery flow rate in a simple way.

Further preferably, the second equation may be a velocity equation in integral form. This equation is preferably based on a hydromechanical differential equation that in particular describes a torque balance and that is transformed into the integral form to be able to calculate the model rotational speed in a simple manner.

For example, the first equation or volume flow equation can be used in the following integral form:

$$Q_{mdl} = \frac{1}{L_{hyd}} \int_0^t \left( \left( a\omega^2 - bQ_{mdl}\omega - cQ_{mdl}^2 \right) - R_{hyd}Q_{mdl}^2 - H_{static} \right) dt \quad \text{Eq1}$$

where

- $Q_{mdl}$ is the delivery flow rate of the centrifugal pump assembly to be determined,
- $\omega$ is a rotational speed or rotational frequency of the centrifugal pump assembly ($\omega=2\pi n$),
- a, b, c are parameters that describe the hydraulic pump performance characteristics ($H(Q, \omega)$) by means of pump curves,
- $R_{hyd}$ is the hydraulic resistance of the hydraulic pipeline network,
- $L_{hyd}$ is the hydraulic inductance of the hydraulic pipeline network and
- $H_{static}$ is a geodetic head.

The numerical solution of this first equation Eq1 can be done by a time-discrete implementation using the so-called forward Euler integration, where the delivery flow rate $Q_{mdl}$ on the left side of the equation at a point of time k+1 is calculated from the delivery flow rate $Q_{mdl}$ on the right side of the equation at point of time k. The numerically solvable time-discrete form of the first equation can then be:

$$Q_{mdl}(k+1) = Q_{mdl}(k) + \frac{1}{L_{hyd}} \left( \left( a\omega^2(k) - bQ_{mdl}(k)\omega(k) - cQ_{mdl}^2(k) \right) - R_{hyd}Q_{mdl}^2(k) - H_{static}(k) \right) \cdot \Delta t \quad \text{Eq1}$$

Here $\Delta t$ is the time interval between one point of time k and the next point of time k+1.

The model parameters a, b, c are known per se, since they represent the static mathematical relationship $H=f(Q, \omega)$ between delivery head H and delivery flow rate Q for any given rotational speed $\omega$, in other words the so-called pump performance characteristics that is regularly measured for centrifugal pump assemblies at the factory and that consists of the sum of all pump curves, i.e. curves $H_\omega=f(Q)$ of constant speed, that are specified by the manufacturer in the technical documentation of the pump assembly. In contrast, the hydraulic resistance $R_{hyd}$ of the pipeline network, the hydraulic inductance $L_{hyd}$ of the pipeline network and its geodetic head $H_{static}$ depend on the pipeline network itself, more precisely on its topology and state, the latter being significantly dependent on the position of the valves in the pipeline network, so that its hydraulic resistance is variable.

Preferably, estimated values are used for the hydraulic resistance $R_{hyd}$ and the hydraulic inductance $L_{hyd}$ at the beginning of the method. By using the method according to the invention, any estimation error is compensated.

In the case of a closed pipeline network, as is the case for example in a heating system or cooling system with a heat transfer medium circulating in a circuit, the geodetic head is zero, so that for this application $H_{static}=0$ can be set. The value for the geodetic head $H_{static}$ can, for example, be manually set by a user on the control electronics of the centrifugal pump assembly if it is constant. However, it is also possible for the control electronics to set the value for the geodetic head $H_{static}$ itself, in particular to zero, based on a given information about the pipeline network or the application (heating system, cooling system) in which the centrifugal pump assembly is operated. In the case of a variable geodetic head, this must be measured or otherwise determined.

To be able to specify exactly the delivery head in addition to or as an alternative to the delivery flow rate, the first equation (volume flow equation) can be separated into a first and second partial equation, where the first partial equation describes the static hydraulic pump performance characteristics for calculating the delivery head and the second partial equation is the dynamic volume flow equation using the calculated delivery head. The second partial equation can also be considered as the main equation as it retains integral form, whereas the first equation can be considered as a secondary equation as it provides a term required in the main equation.

For example, the first partial equation, hereafter Eq1a, and second partial equation, hereafter Eq1b, can be used in the following form:

$$H_{mdl} = a\omega^2 - bQ_{mdl}\omega - cQ_{mdl}^2 \quad \text{Eq1a}$$

$$Q_{mdl} = \frac{1}{L_{hyd}} \int_0^t \left( H_{mdl} - R_{hyd}Q_{mdl}^2 - H_{static} \right) dt \quad \text{Eq1b}$$

where $H_{mdl}$ is the delivery head of the centrifugal pump assembly to be determined, more precisely a model size.

As already explained for the first equation Eq1, the numerical solution of the second partial equation Eq1b can also be carried out by a time-discrete implementation with the aid of the forward Euler integration in that the delivery flow rate $Q_{mdl}$ on the left side of the equation at point of time k+1 is calculated from the delivery flow rate $Q_{mdl}$ on the right side of the equation at point of time k. The numerically solvable time-discrete form of the second partial equation Eq1b can then be:

$$Q_{mdl}(k+1) = Q_{mdl}(k) + \frac{1}{L_{hyd}} \left( H_{mdl}(k) - R_{hyd}Q_{mdl}^2(k) - H_{static}(k) \right) \cdot \Delta t \quad \text{Eq1b}$$

Here $\Delta t$ is the time interval between point of time k+1 and point of time k.

The first partial equation Eq1a can also be implemented time-discrete:

$$H_{mdl}(k) = a\omega^2(k) - bQ_{mdl}(k)\omega(k) - cQ_{mdl}^2(k) \quad \text{Eq1a}$$

In terms of process, the two partial equations Eq1a, Eq1b can be evaluated one after the other. Preferably, the first partial equation Eq1a is evaluated first, i.e. the delivery head $H_{mdl}$ is calculated based on an initial delivery flow rate value $Q_{mdl}(k=1)=Q_{start}$ which can be zero, for example. Subsequently, based on the determined delivery head value $H_{mdl}(k)$ the second partial equation Eq1b is evaluated, i.e. the new delivery flow rate value $Q_{mdl}(k+1)$ is determined.

For the evaluation of the first equation Eq1 or its first partial equation Eq1a, in one embodiment, the actual rotational speed $\omega_{real}$ can be used as the rotational speed w that can be supplied to the pump-motor model for this purpose. This actual speed $\omega_{real}$ can be measured or calculated by the motor control of the electric motor driving the centrifugal pump, which sets the torque in step a.

To ensure that the results are consistent, for the evaluation of the first equation Eq1 or its first partial equation Eq1a, in an alternative embodiment, the model rotational speed $\omega_{mdl}$ can be used as the rotational speed $\omega$ which model rotational speed $\omega_{mdl}$ was previously calculated within the pump-motor model using the second equation or the velocity equation Eq2 respectively. This is possible because the disturbance controller calculating the disturbance signal manages to compensate very well for any rotational speed error, so that the model rotational speed and the real rotational speed are the same.

It should be noted that for the model-based determining the delivery flow rate or the delivery head, the respective other quantity must always also be determined, at least within the pump-motor model, but depending on whether the delivery flow rate or the delivery head or both quantities are to be determined as part of the method according to the invention, either only the delivery flow rate or only the delivery head or both quantities are output from the pump-motor model.

For example, the velocity equation can be used in the following integral form:

$$\omega_{mdl} = \frac{1}{J}\int_0^t\left(T_{mot} - \left(a_t Q_{mdl}\omega - b_t Q_{mdl}^2 - c_t\frac{Q_{mdl}^3}{\omega} + v_i\omega^2 + v_s\omega - I\frac{dQ}{dt}\right) + T_D\right)dt \quad \text{Eq2}$$

where

- $T_{mot}$ is the mechanical torque of the motor of the centrifugal pump assembly,
- $T_D$ is the calculated disturbance signal in the form of a moment,
- $Q_{mdl}$ is the delivery flow rate of the centrifugal pump assembly to be determined,
- $\omega_{mdl}$ is the model rotational speed or rotational frequency of the centrifugal pump assembly ($\omega=2\pi n$),
- $\omega$ is a rotational speed or rotational frequency of the centrifugal pump assembly ($\omega=2\pi n$),
- $a_t$, $b_t$, $c_t$ are parameters that describe the static torque performance characteristics ($T(Q, \omega)$) of the centrifugal pump assembly by means of torque curves,
- $v_i$ is a quantity describing a friction between an impeller of the centrifugal pump assembly and a medium pumped by the centrifugal pump assembly,
- $v_s$ is a quantity describing friction in bearings of the centrifugal pump assembly,
- J is the mass inertia of rotating components of the centrifugal pump assembly (impeller, shaft, rotor), and
- I is the mass inertia of the pumped medium in the impeller.

The velocity equation Eq2 describes in integral form a hydromechanical differential equation in the manner of a torque balance in which the deviation between the motor torque $T_{mot}$ and the theoretical pump torque $T_{mdl}$ plus a modeling error-related disturbance torque $T_D$ is integrated. The motor torque $T_{mot}$ is set by the motor control of the electric motor driving the centrifugal pump to achieve the setpoint rotational speed, or is modulated directly, and to this extent is known from the motor control.

For evaluating the second equation Eq2, as with the first equation Eq1, the actual rotational speed $\omega_{real}$ or the model rotational speed $\omega_{mdl}$ can be used as the rotational speed.

The second equation Eq2 can also be solved numerically by a time-discrete implementation using the forward Euler integration, in that the rotational speed $\omega_{mdl}$ on the left side of the equation at point of time k+1 is calculated from the rotational speed $\omega_{mdl}$ on the right side of the equation at point of time k. The numerically solvable time-discrete form of the second equation Eq2 can then be:

$$\omega_{mdl}(k+1) = \omega_{mdl}(k) + \frac{1}{J}\left(T_{mot}(k) - \left(a_t Q_{mdl}(k)\omega(k) - b_t Q_{mdl}^2(k) - c_t\frac{Q_{mdl}^3(k)}{\omega(k)} + v_i\omega^2(k) + v_s\omega(k) - I\frac{Q(k)-Q(k-1)}{\Delta t}\right) + T_D(k)\right)\cdot\Delta t \quad \text{Eq2}$$

Here, $\Delta t$ is again the time interval between point of time k+1 and point of time k.

The theoretical pump torque $T_{mdl}$ results from a model equation that is described in the second equation Eq2 by the term inside the inner brackets. Therein, the model parameters $a_t$, $b_t$, $c_t$ are known per se, since they represent the static mathematical relationship $T=f(Q, \omega)$ between the torque T and the delivery flow rate Q for an arbitrary rotational speed $\omega$. In other words, they describe the torque performance characteristics that can be measured for centrifugal pump assemblies at the factory and that consists of the sum of all torque curves, i.e. curves $T_\omega=f(Q)$ of constant speed. The model parameters $a_t$, $b_t$, $c_t$ are on the one hand subject to series scattering, i.e. they differ slightly from centrifugal pump assembly to centrifugal pump assembly due to tolerances, in particular by a few percent. On the other hand, they are subject to change due to ageing, in particular due to bearing wear and deposits on the impeller. The quantity $v_i$ describing the friction between impeller and medium and the quantity $v_s$ describing the bearing friction (viscous friction in the hydrodynamic slide bearing) can also be determined by measuring the centrifugal pump assembly at the factory and are in so far known quantities. The mass inertia J can be calculated or measured from design data of the centrifugal pump assembly and is therefore also available from the manufacturer. The same applies to the mass inertia I of the pumped medium in the impeller that is, however, negligibly low, so that the term $$I\frac{dQ}{dt}$$

can be set to zero.

To simplify the calculation of the velocity equation Eq2, it can be separated into a first and second partial equation Eq2a, Eq2b, where the first partial equation Eq2a describes the static hydromechanical pump performance characteristics (torque performance characteristics) for calculating the theoretical pump torque and the second partial equation Eq2b is the dynamic velocity equation using the calculated theoretical pump torque. The second partial equation can also be considered as the main equation in this case, since it keeps the integral form, whereas the first equation can be considered as a secondary equation, since it provides a term needed in the main equation.

For example, the first partial equation Eq2a and second partial equation Eq2b can be used in the following form:

$$T_{mdl} = a_t Q_{mdl}\omega - b_t Q_{mdl}^2 - c_t \frac{Q_{mdl}^3}{\omega} + v_t\omega^2 + v_s\omega - I\frac{dQ}{dt} \quad \text{Eq2a}$$

$$\omega_{mdl} = \frac{1}{J}\int_0^t (T_{mot} - T_{mdl} + T_D)dt \quad \text{Eq2b}$$

wherein $T_{mdl}$ is the theoretical pump torque of the centrifugal pump assembly to be calculated, more precisely a model quantity.

The numerical solution of the second partial equation Eq2b can again be done by a time-discrete implementation using the forward Euler integration, wherein the rotational speed $\omega_{mdl}$ on the left side of the equation at point of time k+1 is calculated from the rotational speed $\omega_{mdl}$ on the right side of the equation at point of time k. The numerically solvable time-discrete form of the second partial equation Eq2b can then be:

$$\omega_{mdl}(k+1) = \omega_{mdl}(k) + \frac{1}{J}(T_{mot}(k) - T_{mdl}(k) + T_D(k))\cdot\Delta t \quad \text{Eq2b}$$

The first partial equation Eq2a can also be implemented time-discrete:

$$T_{mdl}(k) = a_t Q_{mdl}(k)\omega(k) - b_t Q_{mdl}^2(k) - c_t \frac{Q_{mdl}^3(k)}{\omega(k)} + v_t\omega^2(k) + v_s\omega(k) - I\frac{Q(k) - Q(k-1)}{\Delta t} \quad \text{G12a}$$

wherein the term $$I\frac{Q(k) - Q(k-1)}{\Delta t}$$

can also be left out. In terms of process, evaluation of the two partial equations of the velocity equation can be carried out one after the other. Preferably, the first partial equation Eq2a is evaluated first, i.e. the pump torque is calculated, namely, on the one hand, using an initial delivery flow rate value $Q_{mdl}(k=1)=Q_{start}$ which can be zero, for example, and on the other hand based on an initial speed value $\omega_{mdl}(k=1)=\omega_{start}$ greater than zero. Subsequently, based on the determined pump torque $T_{mdl}$ the second partial equation Eq2b is evaluated, i.e. the new model speed $\omega_{mdl}(k+1)$ is determined.

To calculate the disturbance signal, the difference between the actual speed and the model speed may be fed to a controller containing at least one integral component. For example, the controller may be an I, PI or PID controller as is commonly known in control engineering. The disturbance signal may be the output signal of the controller or may be calculated from this controller output signal. The controller may be initialized with the value zero. If there is no difference between the model speed and the actual speed, the disturbance signal remains unchanged. If the difference is greater than zero, the value of the disturbance signal increases; if it is less than zero, the value of the disturbance signal decreases. In this respect, the controller can be considered as a "disturbance controller" which compensates for the deviation between the real pump and the pump model and which brings the model rotational speed into line with the actual rotational speed. The controller output is thus a measure of the (torque) deviation or disturbance of the model. By evaluating this disturbance according to the invention, the model can be dynamically adapted.

As mentioned above, in one embodiment, the output signal of this controller may form the disturbance signal $T_D$. Since this signal $T_D$ is part of a torque equation, the physical quantity of the controller output is a torque or a "disturbance torque" respectively, because a controller output quantity always has the dimension of the manipulated variable on which the controller acts. In another embodiment, the disturbance signal may be formed by multiplying the output signal of this controller by the actual rotational speed, so that this disturbance signal represents a power. Thus, in this case, the disturbance signal $P_D$ may be considered as a "disturbance power". Thus, a basic idea of the method according to the invention is to adapt the at least one model parameter, or even several model parameters at the same time, in such a way that no disturbance torque $T_D$ and/or no disturbance power $P_D$ is present. In other words, the pump-motor model is continuously adapted so that it always replicates reality and compensates for external disturbance effects on the centrifugal pump assembly as well as compensates for any model errors. The pump-motor model is therefore dynamic in this respect.

According to a further development of the method, the combination of the two embodiments mentioned is also possible. Thus, in step d. a first disturbance signal $T_D$ and a second disturbance signal $P_D$ can be determined by feeding the difference between the model rotational speed and the actual rotational speed to a controller containing at least one integral component, the output signal of this controller forming the first disturbance signal $T_D$ and the second disturbance signal $P_D$ then being formed by multiplying the output signal of this controller by the actual rotational speed. In other words, the second disturbance signal can be regarded as calculated from the first disturbance signal. Two disturbance signals $T_D$, $P_D$ are then present that can be further processed separately from each other and each offer the possibility of adapting or updating one or more model parameters of the pump-motor model.

Preferably, a correction signal $T_{D1sin}$ is determined from the disturbance signal $T_D$ and used to adapt a model parameter of the pump-motor model. It is further possible that two or more correction signals $T_{D1sin}$, $T_{D1cos}$ are determined from the disturbance signal $T_D$ and each of these correction signals $T_{D1sin}$, $T_{D1cos}$ is used to adapt a model parameter of the pump-motor model. In this way, two or a number of different model parameters corresponding to the number of correction signals can consequently be adapted simultaneously. Finally, it is also possible that one, two or even more correction signals $T_{D1sin}$, $T_{D1cos}$, $P_{D1sin}$, $P_{D1cos}$ are determined from each of the disturbance signals $T_D$, $P_D$, and that each correction signal $T_{D1sin}$, $T_{D1cos}$, $P_{D1sin}$, $P_{D1cos}$ is used to adapt one particular model parameter $R_{hyd}$, J, $L_{hyd}$, $c_t$ of the pump-motor model. This allows three, four or more model parameters of the pump-motor model to be adapted simultaneously and independently from each other.

In principle, any of the correction signals can be used to adapt one of the model parameters. However, it should be noted that those correction signals which represent an active component, i.e. that are in phase with the excitation of the rotational speed or torque, correct those model parameters which predominantly act on the active power. In contrast, correction signals that represent a reactive power, i.e. that are 90° phase shifted to the excitation, can only correct model parameters that predominantly influence the reactive power.

For example, the model parameter to be adapted may be the hydraulic resistance $R_{hyd}$ of the pipeline network or the model parameter $c_t$. The hydraulic resistance $R_{hyd}$ indicates the steepness of the system characteristic curve of the pipeline network. The hydraulic resistance $R_{hyd}$ changes if the pipeline network has controlled valves, as is the case in heating or cooling systems, for example. Updating the hydraulic resistance $R_{hyd}$ in the pump-motor model is therefore of particular advantage to ensure the accuracy of the delivery head and/or delivery flow rate determination. The model parameter $c_t$ is subject to series scattering from centrifugal pump assembly to centrifugal pump assembly and also changes with the age of the centrifugal pump assembly, whereas the other parameters $a_t$ and $b_t$ have no strong dependence and remain almost constant. The model parameters $R_{hyd}$, $c_t$ affect the active power. Therefore, in this case, it is provided that in step e. the sine or cosine signal is used that is in phase with the excitation signal. In other words, in step g., the sine signal is used when the excitation signal is also a sine signal, and the cosine signal is used when the excitation signal is also a cosine signal.

To adapt both of the above-described model parameters $R_{hyd}$, $c_t$ in a preferred embodiment, the hydraulic resistance $R_{hyd}$ can be adapted as a function of a first correction signal $P_{D1sin}$ formed from the second disturbance signal $P_D$, and the model parameter $c_t$ can be adapted as a function of a first correction signal $T_{D1sin}$ formed from the first disturbance signal $T_D$. However, the reverse is also possible, i.e. that the hydraulic resistance $R_{hyd}$ is adapted as a function of the first correction signal $T_{D1sin}$ formed from the first disturbance signal $T_D$, and the model parameter $c_t$ is adapted as a function of the first correction signal $P_{D1sin}$ formed from the second disturbance signal $P_D$. However, the first mentioned embodiment has the advantage that the $c_t$-term $$c_t \frac{Q^3}{\omega}$$

of the torque equation (Eq2) in the corresponding power equation, due to the multiplication with the rotational speed ($P=T\cdot\omega$), only acts as $c_tQ^3$ and vanishes in the integration of this power equation. Furthermore, it is of course also possible that in one embodiment only one of said model parameters $R_{hyd}$, $c_t$ is adapted and then either the first correction signal $T_{D1sin}$ of the first disturbance signal $T_D$, or the first correction signal $P_{D1sin}$ of the second disturbance signal $P_D$ is used for this purpose.

According to one embodiment, the model parameter to be adapted can be the mass inertia J of the centrifugal pump or the hydraulic inductance $L_{hyd}$ of the pipeline network. An adaptation or updating of the mass inertia J of the centrifugal pump assembly as a model parameter has the advantage that ageing phenomena on the centrifugal pump assembly, such as deposits on the impeller (iron staining) or bearing wear, can be detected, since these increase the mass inertia. If the model parameter "mass inertia" is thus increased within the scope of the method, an indication, in particular a maintenance information, can be output on the centrifugal pump assembly if a predetermined limit value is exceeded. An adaptation or updating of the hydraulic inductance as a model parameter has the advantage that structural changes to the pipeline network can be detected, for example as a result of a fault by which a network section is permanently cut off from the rest, or as a result of a change or extension of the pipeline network. The detection of an increasing or decreasing hydraulic inductance can also be used to output an indication at the centrifugal pump assembly, for example, for the purpose of checking the operating setting of the centrifugal pump assembly and/or to directly adjust the control of the centrifugal pump assembly, for example, by increasing or decreasing its reference rotational speed or a set control curve. These model parameters J, $L_{hyd}$, influence the reactive power. Therefore, in this case, it is provided that in step e. the sine or cosine signal is used that is 90° phase-shifted with respect to the excitation signal. In other words, in step e., the cosine signal is used when the excitation signal is a sine signal, and the sine signal is used when the excitation signal is a cosine signal.

To adapt both of said model parameters J, $L_{hyd}$ in a preferred embodiment, the mass inertia J can be adapted as a function of a second correction signal $P_{D1cos}$ formed from the second disturbance signal $P_D$, and the hydraulic inductance $L_{hyd}$ can be adapted as a function of a second correction signal $T_{D1cos}$ formed from the first disturbance signal $T_D$. However, it is also possible the other way round, i.e. that the mass inertia J is adapted as a function of the second correction signal $T_{D1cos}$ formed from the first disturbance signal $T_D$, and the hydraulic inductance $L_{hyd}$ is adapted as a function of the second correction signal $P_{D1cos}$ formed from the second disturbance signal $P_D$. Furthermore, it is of course also possible that in one embodiment only one of said model parameters J, $L_{hyd}$ is adapted and then either the second correction signal $T_{D1cos}$ of the first disturbance signal $T_D$, or the second correction signal $P_{D1cos}$ of the second disturbance signal $P_D$ is used for this purpose.

In one embodiment, it may further be provided that all four above-mentioned model parameters $R_{hyd}$, $c_t$, J, $L_{hyd}$ are each adapted simultaneously in dependence on the previously mentioned correction signals $T_{D1sin}$, $T_{D1cos}$, $P_{D1sin}$, $P_{D1cos}$, i.e. for example

- the hydraulic resistance $R_{hyd}$ in dependence on the first correction signal $P_{D1sin}$ formed from the second disturbance signal $P_D$,
- the model parameter $c_t$ in dependence on the first correction signal $T_{D1sin}$ formed from the first disturbance signal $T_D$
- the mass inertia J in dependence on the second correction signal $P_{D1cos}$ formed from the second disturbance signal $P_D$ and
- the hydraulic inductance $L_{hyd}$ in dependence on the second correction signal $T_{D1cos}$ formed from the first disturbance signal $T_D$.

In mathematical terms, step e. is a sine/cosine transformation that is performed discretely on a processor. In the following, however, the time-continuous representation of the mathematical relationships is used for the sake of simplicity.

Preferably, determining the correction signal, or in the case of several correction signals determining the respective correction signal, is carried out by using a sine or cosine signal with a the single or a multiple of the excitation frequency. If, for example, the excitation signal has the frequency $\omega t$, then in this case the sine or cosine signal which is multiplied by the disturbance signal, or which is in the case of two disturbance signals multiplied by the respective disturbance signal, also has this single frequency $\omega t$, hereinafter also referred to as the fundamental frequency. However, it is also possible, alternatively or in order to obtain further correction signals additionally, to use a sine or cosine signal with double, triple or another n-th multiple of the fundamental frequency, i.e. with a frequency $2\omega t$, $3\omega t$ or $n\omega t$. However, since the amplitude of the correction signal is largest when the fundamental frequency is used, the use of a sine or cosine signal with the single of the excitation frequency, i.e. the fundamental frequency, is the preferred choice. As described above, in this case already two model parameters per disturbance signal (one model parameter when using a sine signal with fundamental frequency and one model parameter when using a cosine signal with fundamental frequency in step e) can be adapted, i.e. four model parameters when using two disturbance signals (disturbance torque and disturbance power). If, in addition, twice the fundamental frequency is used, two further model parameters can be adapted, and in the case of two disturbance signals even four further model parameters.

In this case, the correction signals can be formed mathematically as follows:

using the fundamental frequency of the excitation signal:

the first correction signal $T_{D1sin}$ of the first disturbance signal $T_D$:

$$T_{D1sin} = \frac{1}{T}\int_0^T T_D \cdot \sin(\omega_A t)dt$$

the second correction signal $T_{D1cos}$ of the first disturbance signal $T_D$:

$$T_{D1cos} = \frac{1}{T}\int_0^T T_D \cdot \cos(\omega_A t)dt$$

the first correction signal $P_{D1sin}$ of the second disturbance signal $P_D$:

$$P_{D1sin} = \frac{1}{T}\int_0^T P_D \cdot \sin(\omega_A t)dt$$

the second correction signal $P_{D1cos}$ of the second disturbance signal $P_D$:

$$P_{D1cos} = \frac{1}{T}\int_0^T P_D \cdot \cos(\omega_A t)dt$$

and using the n-th multiple of the fundamental frequency of the excitation signal:

a correction signal $T_{Dnsin}$ of the first disturbance signal $T_D$:

$$T_{Dnsin} = \frac{1}{T}\int_0^T T_D \cdot \sin(n\omega_A t)dt$$

a correction signal $P_{Dncos}$ of the second disturbance signal $P_D$:

$$P_{Dncos} = \frac{1}{T}\int_0^T P_D \cdot \cos(n\omega_A t)dt$$

From a mathematical point of view, the calculation of the least one or more correction signals is a type of Fourier analysis, but integrals are only calculated for a few individual frequencies. These integrals can be considered as Fourier integrals.

Furthermore, it is possible to use the DC component of the disturbance signal to adapt or update a specific model parameter.

Preferably, the adaptation of the model parameter, or the corresponding model parameter $R_{hyd}$, J, $L_{hyd}$, $c_t$ respectively, is carried out using a controller containing at least one integral component, to which the correction signal, or the corresponding correction signal $T_{D1sin}$, $T_{D1cos}$, $P_{D1sin}$, $P_{D1cos}$ respectively, is fed, and the controller output signal is multiplied by an initial value for the model parameter, or the corresponding model parameter ($R_{hyd}$, J, L, $c_{hydt}$) respectively, to obtain the adapted model parameter $R_{hyd}$, J, $L_{hyd}$, $c_t$. The initial value may be a factory measured value (for mass inertia J or $c_t$) or an average value assumed for the intended operation of the centrifugal pump assembly (for $R_{hyd}$, $L_{hyd}$). The controller can be an I, PI or PID controller. Due to the integral component (I component) in the controller, it acts like an integrator.

The controller output signal can be understood as a correction factor K for the model parameter. The controller can be initialized with the value 1 at the beginning of the method, so that the controller output signal is K=1 and the multiplication with the initial value, at the beginning of the method, results in the adapted model parameter being equal to the initial value, i.e. remaining unchanged. If the correction signal is zero, the controller output signal remains at K=1. However, if the correction signal is greater than 0, the correction factor K increases, and if the correction signal is less than 0, the correction factor K decreases. As a result of the multiplication of the correction factor K by the initial value, the model parameter is then increased or decreased. The controller can thus be considered as a "parameter controller". The advantage of this arrangement is that the controller can be easily limited. For example, the correction factor can be limited to a factor of 5, where permissible values can preferably be between ⅕ and 5. This makes it possible to determine how far the value has moved away from the initial assumption, i.e. the initial value.

It should be noted that, in the context of the present description, the terms "have", "comprise" or "include" in no way exclude the presence of other features. Furthermore, the use of the indefinite article in relation to a subject does not exclude its plural.

BRIEF DESCRIPTION OF THE DRAWING

Further features, characteristics, effects and advantages of the invention will be explained in more detail below with reference to examples or embodiments and the accompanying figures. The reference signs contained in the figures retain their meaning from figure to figure. In the figures, reference signs always denote the same or at least equivalent components, areas, directions or locations. In the drawings.

SPECIFIC DESCRIPTION OF THE INVENTION

Figure 1:
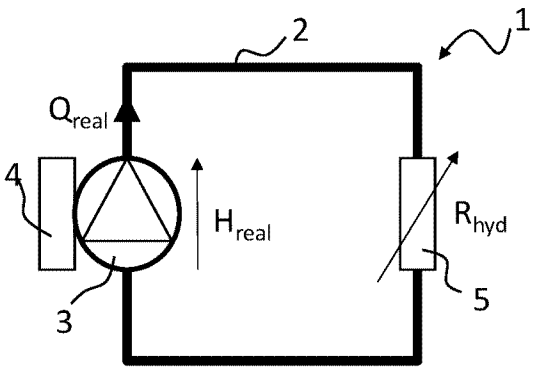
FIG. 1 is a schematic representation of a centrifugal pump assembly within a closed hydraulic pipeline network.

FIG. 1 shows a purely schematic representation of a centrifugal pump assembly 3, 4 within a closed hydraulic system 1 in which the centrifugal pump assembly 3, 4 circulates a fluid. The hydraulic system 1 may be, for example, a heating system or a cooling system for buildings, although for simplicity system components such as a heating source or chiller, heat exchanger, hydraulic separator, valves, etc. are omitted. However, the hydraulic system 1 comprises a pipeline network 2 extending from the centrifugal pump assembly 3, 4 to a number of consumers (supply line), such as radiators, heating circuits of a floor heating or cooling circuits of a cooled ceiling, and extending from these consumers back to the centrifugal pump assembly 3, 4 (return line). In this case, the centrifugal pump assembly 3, 4 is intended to deliver a heat transfer medium, such as water, to the consumers. Control valves, such as thermostatic valves or electrothermal actuators, are associated with these consumers to adjust the volume flow through the respective consumer or through a group of consumers. Due to the varying degree of opening of these control valves, the hydraulic load 5 to be served by the centrifugal pump assembly 3, 4 changes according to the demand from the consumers, the hydraulic load 5, for the sake of simplicity, is symbolized in FIG. 1 by a single, but variable hydraulic resistance $R_{hyd}$. It describes the steepness of the so-called pipeline network parabola of the hydraulic system 1, generally also called system characteristic curve or system curve.

It should be noted that the hydraulic system 1 may also be an open system, as in the case of a borehole pump, a sewage-lifting station or a drinking-water pressure-boosting system.

The centrifugal pump assembly 3, 4 comprises a centrifugal pump 4 including an electric motor drive and a pump electronics or control electronics 4 for controlling the electric motor with or without feedback, the pump or control electronics 4 further being set up for carrying out the method according to the invention. The electric motor may, for example, be a three-phase, permanently excited, electronically commutated synchronous motor. The control electronics 4 comprises a frequency converter for setting a specific rotational speed of the electric motor. In operation, the centrifugal pump 4 generates a differential pressure between its suction and discharge sides, also referred to as delivery head $H_{real}$ that, depending on the hydraulic resistance $R_{hyd}$ of the pipeline network 2 connected to the centrifugal pump 4, results in a delivery flow rate $Q_{real}$.

Figure 2:
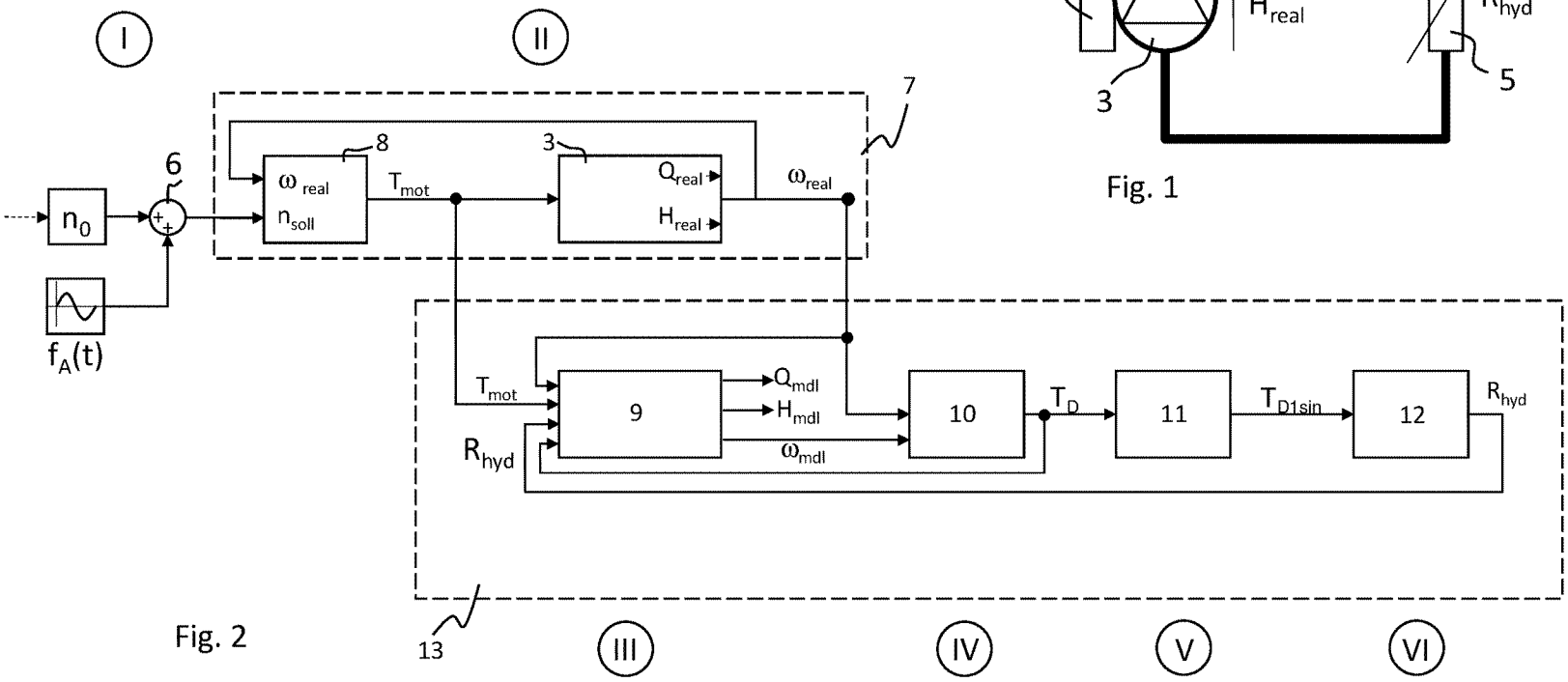
FIG. 2 is a signal flow diagram of a first embodiment of the method according to the invention with singular model parameter adaptation.

A signal flow diagram illustrating the sequence of a first embodiment of the method according to the invention for determining, by calculation, the current delivery head $H_{real}$ and/or the current delivery flow rate $Q_{real}$ as accurately as possible is shown in FIG. 2. The method can be roughly divided into six process sections I to VI that are explained individually below. The process sections I to IV basically take place simultaneously and are repeatedly executed cyclically one after the other as a result of their program-technical processing by a software in the control electronics 4, in particular at the clock speed of a processor not shown in the control electronics 4 on which the method according to the invention runs.

In the first process section I, a periodic excitation of the hydraulic system 1 takes place. In this embodiment, this takes place by applying a periodic excitation signal $f_A(t)$ of a specific excitation frequency $\omega_A$ to a reference rotational speed no of the centrifugal pump assembly 3, 4 to obtain a modulated setpoint rotational speed $n_{soll}$ and thus to modulate the actual rotational speed $n_{real}$ of the centrifugal pump 3, in particular to cause it to fluctuate periodically. It should be noted at this point that in various places in the figures the rotational frequency $\omega$ is used instead of the rotational speed n which rotational frequency $\omega$, due to the relationship $\omega=2\pi n$, does however correspond to the rotational speed n and is understood to be synonymous with it, which is why in the following it is also referred to the "rotational speed $\omega$".

The periodic excitation $f_A(t)$ has the effect of modulating the differential pressure $\Delta p$ of the centrifugal pump 3 or its delivery head $H_{real}$ respectively that is proportional thereto, that, depending on the modulation amplitude and frequency, results in a signaling response of the hydraulic system 1 that in turn is reflected in the torque required to set the modulated setpoint rotational speed $n_{soll}$, and also in the electrical power consumption of the centrifugal pump assembly 3, 4, from which the delivery flow rate Q can be determined. This basic principle is described in U.S. Pat. No. 10,184,476, to which reference is hereby made.

The reference speed no can be an externally specified speed for the centrifugal pump assembly 3, 4 or a speed determined internally in the control electronics 4. The latter can can, for example, originate from a control curve controller upstream of the speed control that, for example, sets the delivery head H as a function of the delivery flow rate Q according to a defined control curve in the so-called HQ diagram, or result from an automatic control that sets the delivery head H as a function of other criteria, e.g. the delivery flow rate change dQ/dt.

For example, the excitation signal $f_A$ can be a sinusoidal signal of the form $f_A=n_1\cdot\sin(\omega_A\cdot t)$, wherein $n_1$ is the excitation amplitude and $\omega_A$ is the excitation frequency. However, the excitation need not be sinusoidal. Another periodic waveform such as a square wave, trapezoidal wave, triangular wave, sawtooth wave or shark fin waveform are also possible. The periodic excitation of the system 1, or the application of the excitation signal $f_A(t)$ to the reference rotational speed $n_0$ respectively, is done by superimposition in an adder 6, to which the reference rotational speed no and the excitation signal $f_A(t)$ are each supplied in terms of signals. The output variable of this adder 6 is the modulated setpoint rotational speed $n_{soll}=n_0+n_1\cdot\sin(\omega_A\cdot t)$. This forms the input variable for the second process step II.

In this second method section II, the motor control 7 known per se is carried out for setting the modulated setpoint rotational speed $n_{soll}$, for example using a vectorial, in particular field-oriented control. Since the actual rotational speed $\omega_{real}$ is the controlled variable in this case, it is directly available from the field-oriented control, either based on a measurement by means of an encoder, by evaluating the voltage induced back into the stator coils by the rotor magnetic field (back EMF) or based on a calculation using a known algorithm for sensorless speed control. The motor control 7 comprises at least one speed controller 8, to which the modulated setpoint rotational speed $n_{soll}$ is fed and which determines the torque $T_{mot}$ required to achieve the modulated setpoint rotational speed $n_{soll}$ as a function of the deviation of the actual rotational speed $\omega_{real}$ from the setpoint rotational speed $n_{soll}$ or, of course, $\omega_{soll}$. The actual rotational speed $\omega_{real}$ is thus also an input variable of the speed controller 8. The speed controller 8 may, for example, be a P, PI or PID controller, in which case the torque $T_{mot}$ is the manipulated variable. It can also be a PI-R controller that has a resonance component at the excitation frequency $\omega_A$ to achieve a lowest possible control deviation.

The determined torque $T_{mot}$ is then set by the motor control 7 on the drive of the centrifugal pump 3 that in FIG. 2 forms a physical system component. Depending on this torque $T_{mot}$, a corresponding (actual) rotational speed $\omega_{real}$ of the centrifugal pump 3 results that then generates a delivery head $H_{real}$ and, depending on the load 5 in the form of the hydraulic resistance $R_{hyd}$, a corresponding delivery flow rate $Q_{real}$. The determined actual rotational speed $\omega_{real}$ is fed to the speed controller 8 to determine the deviation from the setpoint rotational speed $n_{soll}$ and to adjust the torque $T_{mot}$. Such a motor control 7 is known per se.

According to the invention, the determined torque $T_0$ is further fed to a mathematical pump-motor model 9 which simulates the hydromechanical behavior of the centrifugal pump 3. This is a third section III of the method according to the invention and is part of a model-based operating point determination device 13 that is implemented in the control electronics 4 and is set up to determine the delivery head $H_{mdl}$ and/or the delivery flow rate $Q_{mdl}$ of the centrifugal pump 3 from the pump-motor model 9. In terms of control engineering, this pump-motor model 9 represents a so-called observer which ideally enables observation of all state variables of the centrifugal pump 3, i.e. also non-measurable state variables. In particular, the pump-motor model 9 enables an estimation of the actual delivery head $H_{real}$, the actual delivery flow rate $Q_{real}$ and the actual rotational speed $\omega_{real}$ in the form of their respective model quantities $H_{mdl}$, $Q_{mdl}$ and $\omega_{mdl}$, the latter also being referred to as the model rotational speed $\omega_{mdl}$.

Figure 3:
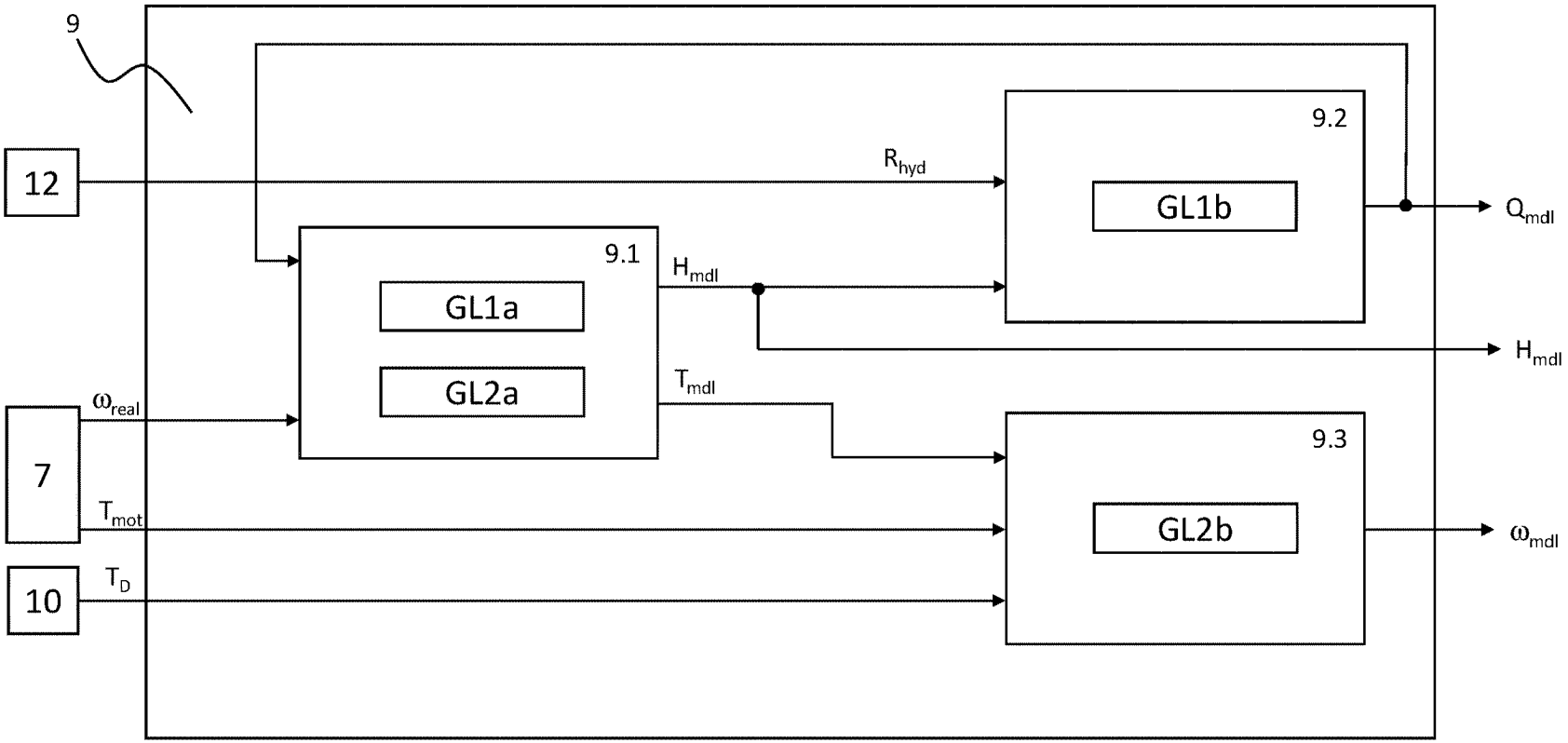
FIG. 3 is a signal flow diagram with an embodiment of the pump-motor model 9 in FIG. 2.

One embodiment of the pump-motor model 9 is illustrated in FIG. 3. It comprises a system of equations based on a first differential equation [Eq1a, Eq1b] and a second differential equation [Eq2a, Eq2b], each of which being transformed into an integral form to form a first and a second integral equation to simplify their calculation. The first integral equation [Eq1a, Eq1b] is based on a hydraulic differential equation describing a pressure balance in the system 1 expressed in heads. It forms a volumetric flow equation since it allows the calculation of the delivery flow rate $Q_{mdl}$. The second integral equation [Eq2a, Eq2b] is based on a hydromechanical differential equation describing a torque balance in the system 1 in consideration of friction losses. It forms a velocity equation since it allows the calculation of the model rotational speed $\omega_{mdl}$. The two integral equations are calculated successively in a time-discrete manner using forward Euler integration.

To simplify the evaluation of the two integral equations, they are each divided into a static first partial equation [Eq1a, Eq2a] (secondary equation) and a dynamic second partial equation [Eq1b, Eq2b] (main equation) that has the integral form. In terms of signal processing, firstly each of the first partial equations [Eq1a, Eq2a] is calculated and then each of the second partial equation [Eq1b, Eq2b] is calculated, and the result of the solution of the respective first partial equation [Eq1a, Eq2a] is used for the calculation of the respective second partial equation [Eq1b, Eq2b], as is made clear below with reference to FIG. 3, which is why the first partial equations can be regarded as secondary equations to the second partial equations that in turn form the main equations due to their integral form.

In total, the system of equations thus consists of the following four partial equations Eq1a, Eq1b, Eq2a, Eq2b, where the first two partial equations Eq1a, Eq1b form a set describing the first integral equation, and the second two partial equations Eq2a, Eq2b form a set describing the second integral equation. In the time-discrete implementation, the partial equations are as follows $$H_{mdl}(k) = a\omega^2(k) - bQ_{mdl}(k)\omega(k) - cQ_{mdl}^2(k) \quad \text{Eq1a}$$

$$Q_{mdl}(k+1) = Q_{mdl}(k) + \frac{1}{L_{hyd}}\left(H_{mdl}(k) - R_{hyd}Q_{mdl}^2(k) - H_{static}(k)\right)\cdot\Delta t \quad \text{Eq1b}$$

$$T_{mdl}(k) = a_t Q_{mdl}(k)\omega(k) - b_t Q_{mdl}^2(k) - c_t\frac{Q_{mdl}^3(k)}{\omega(k)} + v_i\omega^2(k) + v_s\omega(k) \quad \text{Eq2a}$$

$$\omega_{mdl}(k+1) = \omega_{mdl}(k) + \frac{1}{J}(T_{mot}(k) - T_{mdl}(k) + T_D(k))\cdot\Delta t \quad \text{Eq2b}$$

where

- $H_{mdl}$ is the delivery head to be determined of the centrifugal pump assembly 3, 4,
- $Q_{mdl}$ is the delivery flow rate of the centrifugal pump assembly 3, 4 to be determined,
- $\omega$ is a rotational speed or rotational frequency of the centrifugal pump assembly 3, 4 ($\omega=2\pi n$),
- $\omega_{mdl}$ is the model rotational speed of the centrifugal pump assembly 3, 4,
- a, b, c are parameters that describe the hydraulic pump performance characteristics (H (Q, β)) by means of pump curves,
- $R_{hyd}$ is the hydraulic resistance of the pipeline network 2 of the hydraulic system 1,
- $L_{hyd}$ is the hydraulic inductance of the pipeline network 2 of the hydraulic system 1 and
- $H_{static}$ is a geodetic head,
- $T_{mdl}$ is the theoretical pump torque of the centrifugal pump assembly 3, 4 to be calculated,
- $T_{mot}$ is the mechanical torque of the motor (motor torque) of the centrifugal pump assembly,
- $T_D$ is a calculated disturbance signal in the form of a moment (disturbance moment),
- $a_t$, $b_t$, $c_t$ are parameters describing the static torque performance characteristics (T(Q, ω)) of the centrifugal pump assembly 3 by means of torque curves,
- $v_i$ is a quantity describing the friction between an impeller and a medium pumped by the centrifugal pump assembly 3,
- $v_s$ is a quantity describing the bearing friction,
- J is the mass inertia of the rotating components of the centrifugal pump assembly 3, 4 (impeller, shaft, rotor), and
- k is a discrete point of time and
- Δt is the time interval between one point of time k and the next point of time k+1.

In the first partial equation Eq1a of the first integral equation, further pressure terms can be considered, if necessary, to further adapt the pump-motor model 9 to reality. Furthermore, in the first partial equation Eq2a of the second integral equation Eq2 further terms (e.g. for friction) can be considered if necessary.

The pump-motor model 9 in FIG. 3 comprises three function blocks 9.1, 9.2, 9.3. In the second function block 9.2 the main equation Eq1b of the first integral equation (volume flow equation) is evaluated. Furthermore, in the third function block 9.3, the main equation Eq2b of the second integral equation (velocity equation) is evaluated. The second and third function block 9.2, 9.3 are preceded by the first function block 9.1, in which the two secondary equations Eq1a, Eq2a (pressure and torque performance characteristics) of the integral equations are evaluated. The functional combination of the calculation of these two partial equations Eq1a, Eq2a in the first function block 9.1 is done here because both secondary partial equations Eq1a and Eq2a, to be calculated, require the actual rotational speed ω and the delivery flow rate Q. However, in terms of signal processing, the partial equations Eq1a and Eq2a could just as well be calculated in separate function blocks.

The first partial equation Eq1a of the first integral equation (volume flow equation) describes the speed-dependent relationship between delivery flow rate Q and delivery head H, or more precisely the pump performance characteristics, i.e. for each rotational speed ω the dependence of the delivery head H on the delivery flow rate Q, this relationship being referred to as the pump curve $H_\omega(Q)$. Along such a pump curve $H_\omega$ the speed ω is constant. The entirety of all pump curves $H_\omega$ form the pump performance characteristics H(ω, Q). The pump performance characteristics H(ω, Q) is usually measured at the factory and specified in the technical documentation of a centrifugal pump assembly 3, 4. The model parameters a, b, c that mathematically describe the pump performance characteristics H(ω, Q), are therefore known.

To calculate the model quantity $H_{mdl}$ by means of the partial equation Eq11a in the first function block 9.1, the rotational speed ω and the delivery flow rate Q are required. In the embodiment according to FIGS. 2 and 3, the rotational speed ω is provided, in form of the actual rotational speed $\omega_{real}$, by the motor control unit 7 and is fed to the first function block 9.1. As for the delivery flow rate Q, the calculated delivery flow rate $Q_{mdl}$ from the output of the second function block 9.2 is used and is also fed to the first function block 9.1, and, at the start of the method, the delivery flow rate $Q_{mdl}$ is zero or a defined initial value is used. The calculated model variable $H_{mdl}$ is provided at the output of the first function block 9.1 and thus also forms the delivery head $H_{mdl}$ to be determined in accordance with the invention which is provided at the output of the pump-motor model 9 as the first output variable.

In addition, the calculated delivery head model variable $H_{mdl}$ is transferred to the second function block 9.2, in which it is used to calculate the delivery flow rate $Q_{mdl}$ by means of the second partial equation Eq1b of the first integral equation. For the evaluation of this partial equation Eq1b, the hydraulic resistance $R_{hyd}$, the hydraulic inductance $L_{hyd}$, the current delivery flow rate $Q_{mdl}$ and the geodetic head $H_{static}$ are also required.

The second partial equation Eq1b of the first integral equation is based on the hydraulic differential equation:

$$H(n, Q) = R_{hyd}Q^2 + L_{hyd}\frac{dQ}{dt} + H_{static}$$

that describes the system characteristic curve of the pipeline network 2, and of the hydraulic system 1 respectively, that depends significantly on the position/degree of opening of the valves on the consumer side, i.e. on the hydraulic resistance $R_{hyd}$.

The geodetic head $H_{static}$ is the minimum head H that must be reached in order for a flow (Q>0) to be possible at all. In closed hydraulic systems, i.e. those pipeline networks in which the pumped medium circulates, such as in a heating or cooling system, the geodetic head $H_{static}$ is zero and can be neglected in this case. In the case of an open system, the geodetic head $H_{static}$ can, for example, be measured or specified on the pump electronics 4 of the centrifugal pump 3 by a user.

The hydraulic resistance $R_{hyd}$ and the hydraulic inductance $L_{hyd}$ are initially unknown, since these parameters are part of the user's hydraulic system 1 that the pump manufacturer does not know. The hydraulic inductance $L_{hyd}$, together with the volume flow, is a measure of the kinetic energy stored in the flowing water mass. Provided that the hydraulic system 1 is not changed structurally, the hydraulic inductance $L_{hyd}$ consequently does not change either. In the embodiment according to FIGS. 2 and 3, the hydraulic inductance $L_{hyd}$ can be determined by a simple estimation. In contrast, the hydraulic resistance $R_{hyd}$ changes dynamically during operation of the hydraulic system 1 as a function of the demand of the consumers, in particular the heating or cooling demand, i.e. as a function of the position of the control valves on the consumer side which adjust the volume flow through the consumers. However, when the valves close completely, the hydraulic inductance $L_{hyd}$ also changes.

In the first embodiment, the hydraulic resistance $R_{hyd}$ is a model parameter of the pump-motor model 9 which is dynamically adapted according to the invention. It is repeatedly redetermined by a parameter controller 12 and fed to the pump-motor model 9, more specifically to the second function block 9.2, to be used in partial equation Eq1b. Since the hydraulic resistance $R_{hyd}$ is unknown at the beginning of the method, any initial value can be used for $R_{hyd}$. This is because during the method its value is corrected by the parameter controller 12 towards the real value, as will be explained further below.

The delivery flow rate value Q to be used in equation Eq1b is the delivery flow rate value that is valid at the current point of time k. Partial equation Eq1b can thus be evaluated and the new delivery flow rate value $Q_{mdl}(k+1)$ can be determined. It thus represents the output signal of the second function block 9.2 as well as the second output variable of the pump-motor model 9.

The first part Eq2a of the second integral equation (velocity equation) describes the speed-dependent relationship between torque T and delivery flow rate Q. It is therefore basically a torque equation. Like partial equation Eq1a, it requires the current rotational speed ω(k) and the current delivery flow rate Q(k). As explained in relation to the individual equation Eq1a, the rotational speed co used here is the actual rotational speed $\omega_{real}$ supplied by the motor control 7 to the first function block 9.1 and the current delivery flow rate Q(k) used here is the delivery flow rate $Q_{mdl}(k+1)$ from the output of the second function block 9.2 last calculated with partial equation Eq1b.

The term $v_i\omega^2$ in partial equation Eq2a describes the friction between impeller and medium, the term $v_s\omega$ describes the bearing friction losses resulting from the bearing of the pump shaft or motor shaft. Both quantities $v_i$ and $v_s$ can be determined at the factory by measuring the centrifugal pump assembly and are therefore known. Furthermore, the term $$I\frac{dQ}{dt}$$

describes the mass inertia (also called moment of inertia) of the medium in the impeller. Due to the comparatively small amount of pumped medium in the impeller, the term $$I\frac{dQ}{dt}$$

is comparatively small and can be neglected.

The model parameters $a_t$, $b_t$ and $c_t$ describe the physical relationship between the torque T, delivery flow rate Q and rotational speed ω, in other words the torque performance characteristics T(ω, Q) of the centrifugal pump assembly 3, 4 formed by the individual torque curves $T_\omega(Q)$, wherein the speed ω is constant along a torque curve $T_\omega(Q)$. Since, as previously stated, each pump assembly is measured by the manufacturer and its hydraulic and hydromechanical pump performance characteristics are known to the manufacturer, the model parameters $a_t$, $b_t$ and $c_t$ are also known per se. In the present example, the model parameter $c_t$ is a value that can change over time. Its initial value can also be determined at the factory by measuring the centrifugal pump 3.

The calculated model quantity $T_{mdl}$ is also provided at the output of the first function block 9.1 and transferred to the third function block 9.3, in which it is used to calculate the model rotational speed $\omega_{mdl}$ by means of the second partial equation Eq2b of the second integral equation. For the evaluation of this partial equation Eq2b, it is also required the mass inertia J (also called moment of inertia J), the motor torque $T_{mot}$ and the value of a disturbance torque $T_D$ which disturbance torque $T_D$ exists in the event of a deviation of the model rotational speed from the actual rotational speed, i.e. that the disturbance torque $T_D$ has a magnitude other than zero. The mass inertia J of the rotating components (shaft, rotor, impeller) of the centrifugal pump 3 can also be determined at the factory by measuring the centrifugal pump 3 or can be calculated from design data. The motor torque $T_{mot}$ is fed to the pump-motor model 9, and to the third function block 9.3 respectively, by the motor control 7. Furthermore, the disturbance torque $T_D$ is determined by a disturbance controller 10 and is also fed to the pump-motor model 9 and to the third function block 9.3 respectively.

Partial equation Eq2b can thus be evaluated and the model rotational speed $\omega_{mdl}$ determined. It thus represents the output signal of the third function block 9.3 as well as the third output variable of the pump-motor model 9.

The equations of the pump-motor model 9 are continuously calculated repeatedly, in particular depending on the clock frequency of the processor of the control electronics 4 on which this calculation is performed. In each clock cycle a new delivery flow rate value $Q_{mdl}(k+1)$ and rotational speed value $\omega_{mdl}(k+1)$ is calculated from the delivery flow rate value $Q_{mdl}(k)$ and rotational speed value $\omega_{mdl}(k)$ used in the previous clock cycle.

With the aid of the pump-motor model 9 (observer) the current rotational speed of the centrifugal pump 3 is estimated as the model rotational speed $\omega_{mdl}$ and fed to a disturbance controller 10 that also receives the actual rotational speed $\omega_{real}$ of the centrifugal pump 3. The disturbance controller 10 forms a fourth process section IV, compare FIG. 2. It first determines whether and to what extent there is a deviation of the model rotational speed $\omega_{mdl}$ from the actual rotational speed $\omega_{real}$ and determines a disturbance signal $T_D$ from this deviation. In this respect, the disturbance controller 10 forms a disturbance signal calculation unit. It is responsible for setting or controlling the model rotational speed $\omega_{mdl}$ so that it corresponds to the real rotational speed $\omega_{real}$.

Figure 4:
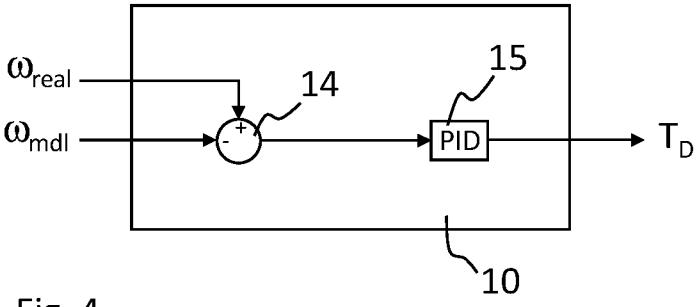
FIG. 4 is an embodiment of the disturbance controller 10 in FIG. 2.

A first embodiment of the disturbance controller 10 is shown in FIG. 4. It comprises a subtractor 14 which calculates the deviation ($\omega_{real}-\omega_{mdl}$) of the model rotational speed $\omega_{mdl}$ from the actual rotational speed $\omega_{real}$ of the centrifugal pump assembly 3, 4. This part of the disturbance controller 10, together with the pump-motor model 9, can be understood as a "torque observer", because a deviation of the model rotational speed $\omega_{mdl}$ from the actual rotational speed $\omega_{real}$ means a deviation of the model 9 from reality, which manifests itself in a disturbance torque that in turn is responsible for the rotational speed deviation. Furthermore, the disturbance controller 10 comprises a controller 15 having an integral component, which controller is here a PID controller. The calculated deviation or rotational speed difference is fed to this controller 15 and is integrated due to the integral component. The physical quantity of the controller output is defined by the connected manipulated variable, so that the controller output signal (manipulated variable of the controller) physically corresponds to a torque.

In the first embodiment of the disturbance controller 10, the controller output signal directly forms the disturbance signal $T_D$ that can accordingly be regarded as the disturbance torque $T_D$. If the speeds $\omega_{mdl}$ and $\omega_{real}$ differ, then the pump-motor model 9 does not match reality. Thus, the disturbance controller 10 may also be referred to as a "disturbance observer". The disturbance torque $T_D$ accelerates the model rotational speed $\omega_{mdl}$ when the latter is less than the actual rotational speed $\omega_{real}$, and brakes the model rotational speed $\omega_{mdl}$ when the latter is greater than the actual rotational speed $\omega_{real}$. In this way, the disturbance signal $T_D$ compensates for a deviation of the pump-motor model 9 from reality. Such a deviation can, for example, be caused by inaccurate parameter values, but can also be due to external disturbances, such as torque fluctuations due to particles or bubbles in the pumped medium or due to changing bearing friction.

The PID controller 15 of the disturbance controller 10 is initialized with the value 0. If the rotational speeds $\omega_{real}$ and $\omega_{mdl}$ are identical, their deviation is zero and the disturbance signal $T_D$ (disturbance torque) is constant and also zero at the beginning of the process. If there is a negative deviation between the rotational speeds $\omega_{mdl}$ and $\omega_{real}$, i.e. that the actual rotational speed $\omega_{real}$ lags behind the model rotational speed $\omega_{mdl}$, the disturbance signal $T_D$ falls. This can be interpreted to mean that in reality a disturbance torque (braking torque) is acting, as a result of which the centrifugal pump 3 actually has a lower rotational speed $\omega_{real}$ than it is estimated by the pump-motor model 9. In other words, losses (e.g. friction losses/bearing wear, higher hydraulic resistance, higher inertia force, etc.) acting in reality are not taken into account in the (idealized) pump-motor model 9, so that the pump-motor model 9 overestimates the model rotational speed $\omega_{mdl}$. If there is a positive deviation between the rotational speeds $\omega_{mdl}$ and $\omega_{real}$, i.e. that the model rotational speed $\omega_{mdl}$ is estimated to be lower than the actual rotational speed $\omega_{real}$, the disturbance signal $T_D$ increases steadily as a result of the I component of the controller 15. A too low model rotational speed $\omega_{mdl}$ can be present if the pump-motor model 9 models the centrifugal pump assembly 3, 4 together with the connected system 1 too lossy, perhaps the pump-motor model 9 is overadjusted.

The disturbance signal $T_D$ is then fed to an evaluation unit 11 and evaluated therein, which represents a fifth process section V. The evaluation unit 11 according to FIG. 2 is set up to determine a correction signal $T_{D1sin}$ from the disturbance signal $T_D$. This is done in such a way that the disturbance signal $T_D$ is first multiplied by a sine signal whose frequency corresponds to the single of the excitation frequency $\omega_A$, i.e. to the fundamental frequency of the excitation signal $f_A(t)$. The product thus formed is then integrated over at least one period T of the excitation signal $f_A(t)$ to obtain the correction signal $T_{D1sin}$. Mathematically, this is a sine-transformation. The correction signal $T_{D1sin}$ can thus be determined as follows:

$$T_{D1sin} = \frac{1}{T}\int_t^{t+T} T_D(t)\cdot\sin(\omega_A t)dt$$

The correction signal $T_{D1sin}$ is then fed to a parameter controller 12 that is set up to carry out an adaptation of a model parameter as a function of the correction signal $T_{D1sin}$. In the embodiment according to FIG. 2, the model parameter to be adapted is (only) the hydraulic resistance $R_{hyd}$ of the pipeline network 2.

Figure 5:
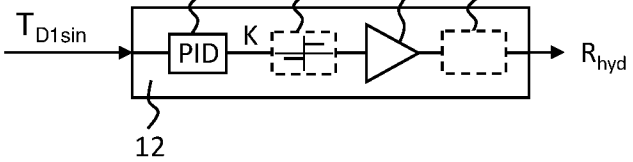
FIGS. 5-8 show different versions of the parameter controller 12 in FIG. 2.

A first embodiment of the parameter controller 12 is shown in FIG. 5. It comprises a controller 17 with integral component to which the correction signal $T_{D1sin}$ is fed. The controller 17 is implemented here as a PID controller. The output signal of this controller 17 represents a correction factor K. At the beginning of the method the controller 17 is initialized with the value 1, so that the correction factor K initially has the value 1. The parameter controller 12 further comprises a multiplier 19 which multiplies the correction factor K by an initial value of the model parameter $R_{hyd}$. Consequently, if the correction factor is K=1, the initial value is not corrected so that the model parameter $R_{hyd}$ is equal to the initial value. If the correction signal $T_{D1sin}$ is zero, the correction factor K remains unchanged. If the correction signal $T_{D1sin}$ is greater than zero, the correction factor K is increased as a result of the integral component of the controller 17. If the correction signal $T_{D1sin}$ is less than zero, the correction factor K is decreased as a result of the integration of the correction signal $T_{D1sin}$. The model parameter $R_{hyd}$ is consequently dynamically adapted, in particular "controlled", by the parameter controller 12, the correction factor K indicating as a manipulated variable the extent of the deviation of the model parameter $R_{hyd}$ from the initial value.

The correction factor K thus generally makes it possible to obtain further information about the centrifugal pump assembly 3, 4 or the pipeline network 2, such as for example information about ageing/wear of the centrifugal pump 3, deposits on the impeller (iron staining) or a disturbance in the pipeline network. This makes it possible to monitor the condition of the centrifugal pump assembly 3, 4. If the correction factor K exceeds or falls below a predetermined limit value, an error message, a warning and/or maintenance notice can be issued.

The parameter controller 12 may further comprise a correction factor limitation 18 which limits the correction factor K to an upper and/or lower limit value, for example to the upper value 5 or to the lower value ⅕, so that the permissible range of values for the model parameter to be adapted is at most five times and one fifth of the initial value. In terms of signal processing, the correction factor limitation 18 is thus located between the controller 17 and the multiplier 19. The correction factor limitation 18 prevents the model 9 from moving too far away from the real system, for example, due to temporarily incorrect measured values. If, for example, a delivery flow rate Q=0 is present, the resistance $R_{hyd}$ would have to be infinitely large. This means that this condition would never be reached by integration. Conversely, it would then also take a very long time to return from infinity to another operating point. However, since the result does not change significantly at very low volume flows, it makes sense to limit the resistance $R_{hyd}$. It can also be assumed for other model parameters that they can only change within a certain range. Otherwise, there may be another error, e.g. a measurement error.

Further, the parameter controller 12 may include a linearization unit 20 such that the parameter controller 12 exhibits the same behavior if rising as if falling and that the disturbance signal $T_{D1sin}$ becomes proportional to the change in delivery flow rate.

The model parameter $R_{hyd}$, possibly adapted by the parameter controller 12, is then fed to the pump-motor model 9. The pump-motor model 9 then uses the adapted model parameter in the second function block 9.2 to calculate the delivery flow rate $Q_{mdl}$.

Figure 9:
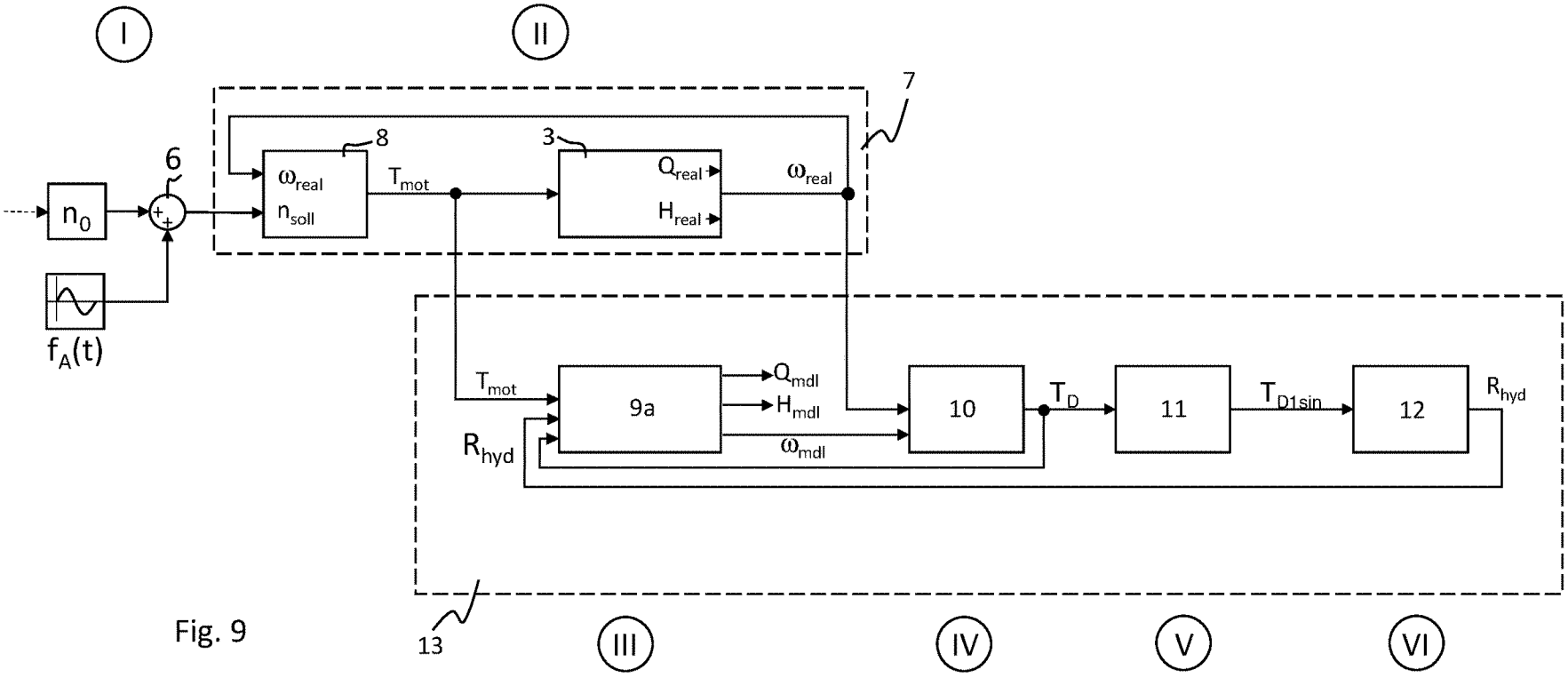
FIG. 9 is a signal flow diagram of a second embodiment of the method according to the invention with singular model parameter adaptation without actual rotational speed feed to the pump-motor model 9.
Figure 10:
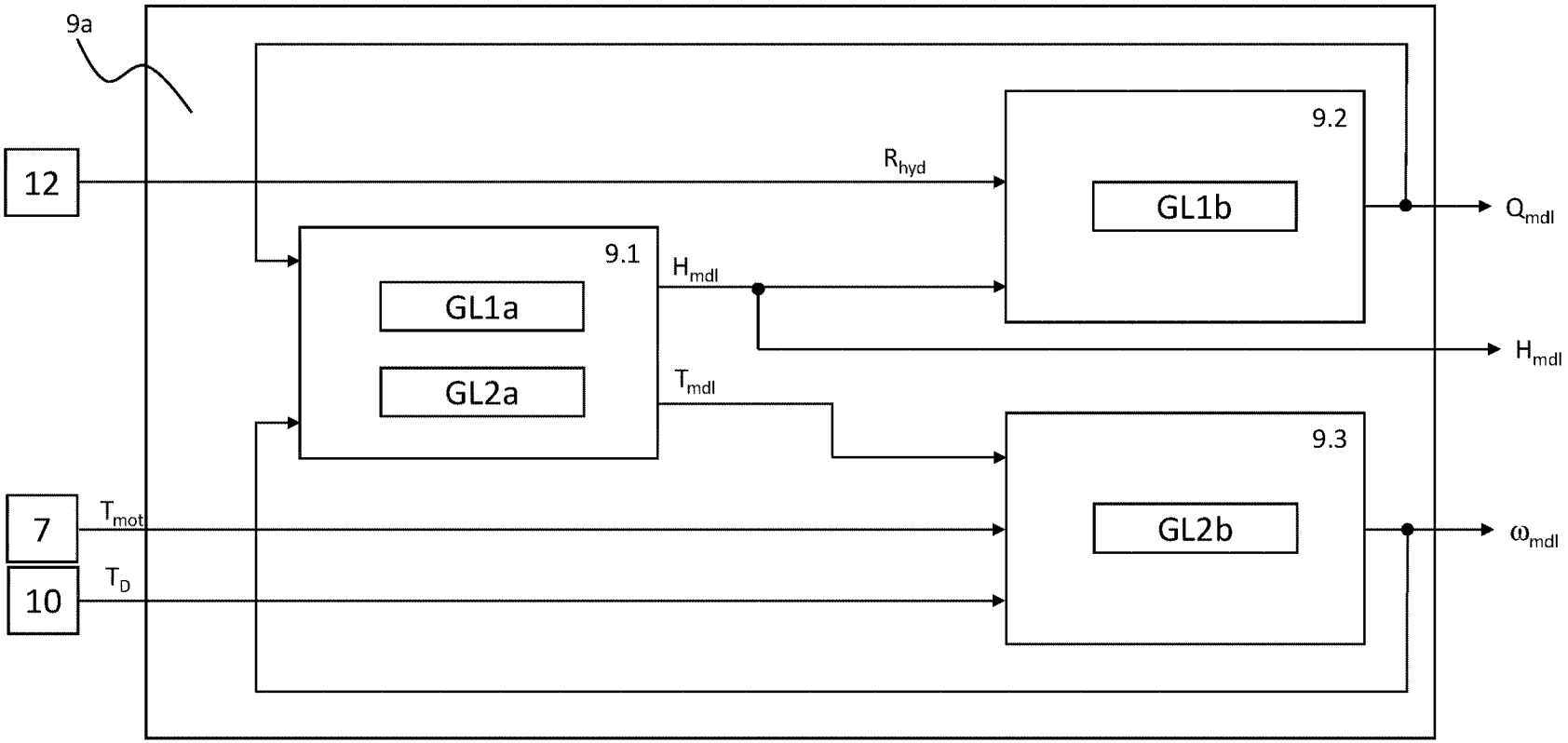
FIG. 10 is a signal flow diagram with an embodiment of the pump-motor model 9*a* in FIG. 9 with internal use of the model rotational speed.

FIGS. 9 and 10 show a second embodiment of the pump-motor model 9*a*. It differs from the first embodiment in that no actual rotational speed $\omega_{real}$ is fed to the pump-motor model 9*a* from the motor control 7. Instead, the model rotational speed $\omega_{mdl}$ calculated internally in the previous cycle is used in the pump-motor model 9*a* for the individual equations Eq1a, Eq2a, for which the output of the third function block 9.3 is fed back to the input of the first function block 9.1, see FIG. 10. This is possible because the disturbance controller 10 is able to compensate very well for any rotational speed error.

The individual sections I-VI of the method according to the invention, which can also be regarded as function sections, are summarized once again in the following table:

| Method section | Function block | Function |
|---|---|---|
| I | Rotational Speed Setting | Periodic excitation of a reference speed |
| II | Motor control | Speed control and determining actual rotational speed and torque |
| III | Pump-motor model | Calculation/observation of rotational speed, delivery head and delivery flow rate |
| IV | Disturbance controller | Calculating a disturbance signal; controller with high bandwidth, or a bandwidth of at least one decade above the excitation frequency; ensures that model rotational speed corresponds to actual rotational speed |
| V | Evaluation unit | Calculating one or more correction signals from the disturbance signal |
| VI | Parameter controller | Model parameter adjustment as a function of the correction signal |

This method improves the accuracy of the delivery flow rate and/or delivery head determination, since any disturbance torque $T_D$ is counteracted by the disturbance controller 10 and the subsequent parameter adaptation in the parameter controller 12, thereby reducing the noise in the delivery flow rate and/or delivery head signal compared to the prior art approach. Thus, the signal quality can be improved or a lower excitation amplitude than in the prior art can be used for the excitation signal while maintaining the quality, and a subsequent smoothing by filtering can be reduced, so that a faster reaction of the centrifugal pump assembly 3, 4 to system state changes or disturbances in the hydraulic pipeline network 2 can take place. As a result of the adaptation of the model parameter during operation of the centrifugal pump assembly 3, 4, any inaccuracies in the pump-motor model 9 are also compensated for, which may be due to a scattering of the model parameters in series production and/or wear due to ageing, for example of the bearings of the centrifugal pump 3.

Figure 6:
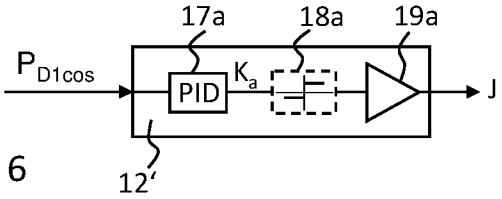
Figure 7:
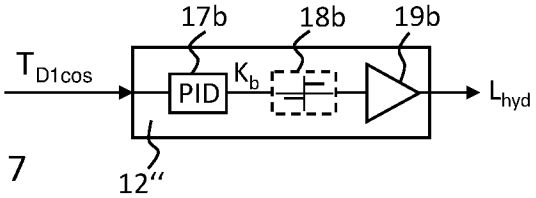
Figure 8:
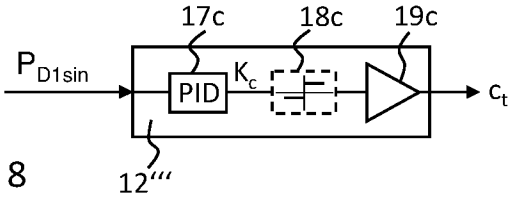

In principle, only the hydraulic resistance $R_{hyd}$ needs to be updated to determine the delivery flow rate Q, at least if the other model parameters are known from a measurement, estimate, calculation, etc., since $R_{hyd}$ is the only dynamically variable parameter. Nevertheless, the hydraulic resistance $R_{hyd}$ could also be determined in another way and fed to the pump-motor model 9. The method according to the invention is thus not limited to updating the hydraulic resistance $R_{hyd}$ with the evaluation unit 11 and the parameter controller 12. Rather, a single other parameter can also be updated, such as the mass inertia J, the hydraulic inductance $L_{hyd}$ or the parameter $c_t$. In the case of the mass inertia J, the parameter controller 12 in FIG. 2 or 9 is formed by the mass inertia controller 12' from FIG. 6, in the case of the hydraulic inductance $L_{hyd}$ by the inductance controller 12" from FIG. 7 and in the case of the parameter $c_t$ by the $c_t$ controller 12'" from FIG. 8. In each of these three cases, the evaluation unit 11 also outputs a different correction signal, as will be explained below.

However, to improve the accuracy of the delivery flow rate determination, in particular also in case of series scattering (model parameters for different pumps of the same series may differ due to manufacturing and tolerances) as well as over the several years of operation of the centrifugal pump assembly 3, 4, i.e. in case of ageing effects, the above-described further parameters of the pump-motor model 9 can be updated in addition to the hydraulic resistance. It is then also possible to obtain further information about, for example, the wear of the centrifugal pump assembly 3, 4.

Figure 11:
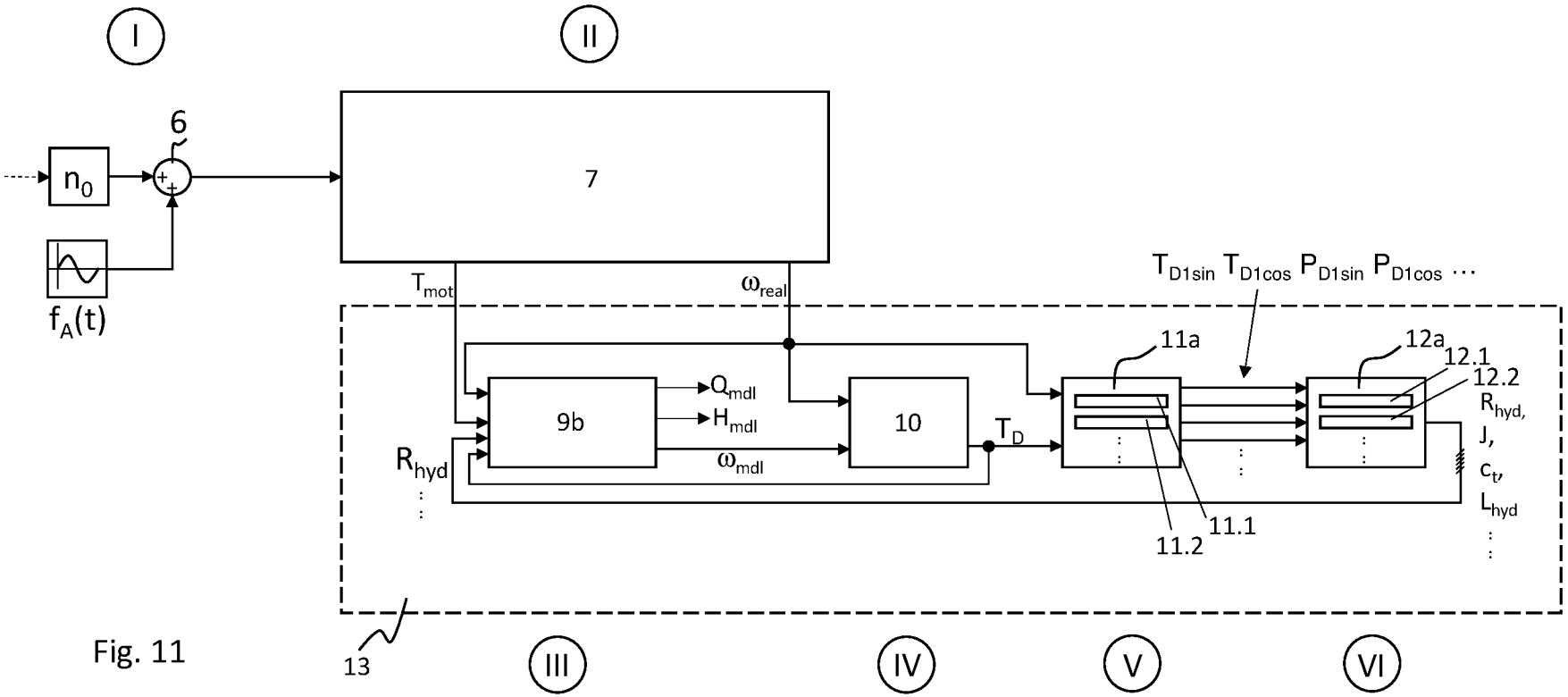
FIG. 11 is a signal flow diagram of a third embodiment of the method according to the invention comprising a multi-model parameter adaptation and a single disturbance variable on the output side of the disturbance controller 10.

FIG. 11 shows a third embodiment of the method according to the invention. It differs from the first and second embodiments essentially in that the evaluation unit 11*a* receives the actual rotational speed $\omega_{real}$ and calculates several correction signals, and each correction signal can be used to adapt a single model parameter, so that a number of model parameters of the pump-motor model 9*b* corresponding to the number of correction signals can be adapted simultaneously. In this regard, each correction signal is calculated in a correction signal calculation unit 11.1, 11.2, all of which are part of the evaluation unit 11*a*. From the actual rotational speed $\omega_{real}$, the evaluation unit 11*a* can calculate a second disturbance signal $P_D$. Further, the evaluation unit 11*a* may calculate one or more correction signals from both the first disturbance signal $T_D$ and this second disturbance signal $P_D$ respectively.

The evaluation unit 11*a* according to FIG. 11 is set up to perform a discrete sine/cosine transformation of the disturbance signal $T_D$, or the disturbance torque $T_D$ respectively, at the fundamental frequency $\omega_A$ of the excitation signal $f_A(t)$. On the one hand, by integrating the product of the disturbance signal $T_D$ and a sinusoidal signal with said fundamental frequency $\omega_A$, it is calculated a first correction signal $T_{D1sin}$ which represents an active part (or real part) and which is in phase with the excitation signal $f_A(t)$ as well as a second correction signal $T_{D1cos}$ which represents a reactive part (or imaginary part) and which is orthogonal to the excitation signal $f_A(t)$. In addition, the DC component $T_{D0}$ of the disturbance signal $T_D$ can be calculated as a third correction signal. These three correction signals can be used to adapt three parameters of the pump-motor model 9*b*, since they would disappear in an error-free model. Mathematically, the three correction signals $T_{D1sin}$, $T_{D1cos}$, $T_{D0}$ can be represented by the following integrals, each of which is calculated in one of the correction signal calculation units 11.1, 11.2:

$$T_{D1sin} = \frac{1}{T}\int_t^{t+T} T_D(t)\cdot\sin(\omega_A t)dt$$

$$T_{D1cos} = \frac{1}{T}\int_t^{t+T} T_D(t)\cdot\cos(\omega_A t)dt$$

$$T_{D0} = \frac{1}{T}\int_t^{t+T} T_D(t)dt$$

In the same way even further frequencies can be excited and evaluated. One receives thereby per frequency $n\omega_A t$ two further correction signals $T_{Dnsin}$, $T_{Dncos}$ from the first disturbance signal $T_D$ that can be calculated in corresponding correction signal calculation units 11.1, 11.2:

$$T_{Dnsin} = \frac{1}{T}\int_t^{t+T} T_D(t)\cdot\sin(n\omega_A t)dt$$

$$T_{Dncos} = \frac{1}{T}\int_t^{t+T} T_D(t)\cdot\cos(n\omega_A t)dt$$

These can be used to update two further model parameters.

As already mentioned, the evaluation unit 11*a* is further set up to calculate a second disturbance signal $P_D$ and to perform a discrete sine/cosine transformation of this second disturbance signal $P_D$ at the fundamental frequency of the excitation signal $f_A(t)$. For this purpose, the product of the first disturbance signal, or the disturbance torque $T_D$ respectively, and the actual rotational speed $\omega_{real}$ is first calculated that represents a power $P_D=T_D\cdot\omega_{real}$ which can be referred to as "disturbance power" in analogy to the disturbance torque $T_D$.

Figure 13:
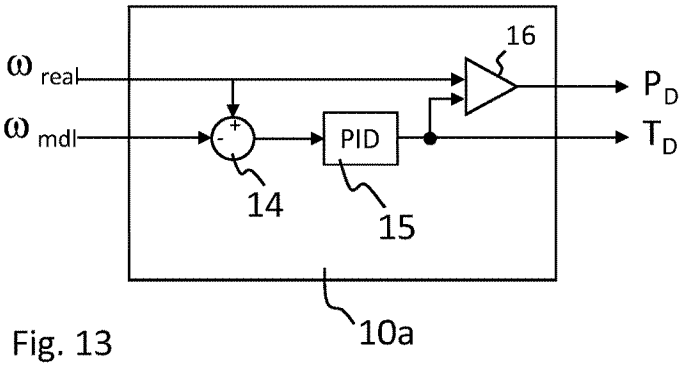
FIG. 13 is an embodiment of the disturbance controller 10*a* in FIG. 12.
Figure 12:
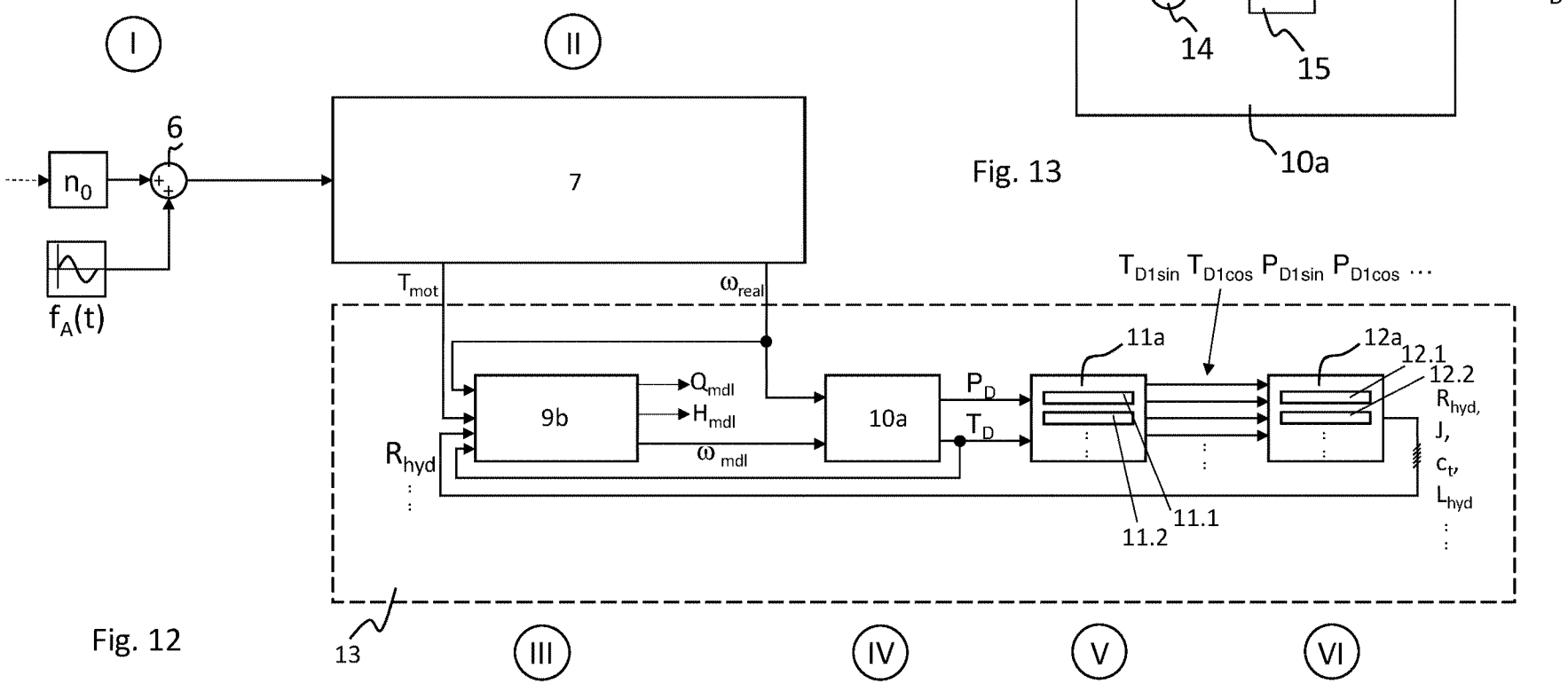
FIG. 12 is a signal flow diagram of a fourth embodiment of the method according to the invention with multi-model parameter adaptation and two disturbance variables on the output side of the disturbance controller 10*a;*

Alternatively to the calculation of the second disturbance signal $P_D$ in the evaluation unit 11*a*, this calculation can be performed in the disturbance controller 10*a*. FIGS. 12 and 13 illustrate such an embodiment. Thus, the actual rotational speed does not have to be supplied to the evaluation unit. As can be seen from FIG. 13, the disturbance controller 10*a* used in FIG. 12 in this case additionally comprises a multiplier 16 which multiplies the output signal of the controller 15, i.e. the disturbance torque $T_D$, by the actual rotational speed $\omega_{real}$ and thus provides a disturbance power $P_D$ at its output. The disturbance torque $T_D$ is then the first disturbance signal $T_D$ and the disturbance power $P_D$ is the second disturbance signal $P_D$, both of which are transferred by the disturbance controller 10*a* to the evaluation unit 11*a* so that it does not have to calculate the second disturbance signal $P_D$.

From the second disturbance signal $P_D$, the evaluation unit 11*a* calculates, by integrating the product of the second disturbance signal $P_D$ and a sinusoidal signal having said fundamental frequency $\omega_A$, a fourth correction signal $P_{D1sin}$ which represents an active part (or real part) and which is in phase with the excitation signal $f_A(t)$, as well as a fifth correction signal $P_{D1cos}$ representing a reactive part (or imaginary part) and which is orthogonal to the excitation signal $f_A(t)$. In addition, the DC component $P_{D0}$ of the second disturbance signal $P_D$ can be calculated as a sixth correction signal. Thus, three further correction signals $P_{D1sin}$, $P_{D1cos}$, $P_{D0}$ can be determined by forming the following integrals, which is performed in each case in one of the correction signal calculation units 11.1, 11.2:

$$P_{D1sin} = \frac{1}{T}\int_t^{t+T} P_D(t)\cdot\sin(\omega t)dt$$

$$P_{D1cos} = \frac{1}{T}\int_t^{t+T} P_D(t)\cdot\cos(\omega t)dt$$

$$P_{D0} = \frac{1}{T}\int_t^{t+T} P_D(t)dt$$

with $P_D=T_D(t)\cdot\omega_{real}(t)$

In the same way, further frequencies can be excited and evaluated. One receives thereby per frequency $n\omega_A t$ two further correction signals $P_{Dnsin}$, $P_{Dncos}$ from the second disturbance signal $P_D$ $$P_{Dnsin} = \frac{1}{T}\int_t^{t+T} P_D(t)\cdot\sin(n\omega_A t)dt$$

$$P_{Dncos} = \frac{1}{T}\int_t^{t+T} P_D(t)\cdot\cos(n\omega_A t)dt$$

which can be used to update two further model parameters.

Of course, the evaluation unit 11*a* does not necessarily have to calculate all the above-described correction signals. Rather, this can be done as required and desired.

The correction signals $T_{D1sin}$, $T_{D1cos}$, $P_{D1sin}$, $P_{D1cos}$, $T_{D0}$, $P_{D0}$ etc. calculated by the evaluation unit 11 are then fed to the parameter controller 12*a* that is set up to adapt one model parameter per correction signal. This is done in single parameter controllers 12.1, 12.2, etc., each of which is supplied with a particular correction signal. Thus, six model parameters can be adapted simultaneously by this parameter controller 12*a*. The parameter controller 12 thus consists, more precisely, of a number of individual parameter controllers 12.1, 12.2, each of which may have a structure as in FIG. 5, 6, 7 or 8, and each of which provides a model parameter. In FIG. 5 this is the hydraulic resistance $R_{hyd}$, in FIG. 6 the mass inertia J of the rotating components of the centrifugal pump 3, in FIG. 7 the hydraulic inductance $L_{hyd}$ and in FIG. 8 the model parameter $c_t$. The parameter controller 12 in FIG. 5 differs from the other parameter controllers 12', 12", 12'" of FIGS. 6 to 8 only in that it comprises a linearisation unit 20. In addition, each parameter controller 12, 12', 12", 12'" has a controller 17, 17*a*, 17*b*, 17*c* with an integral component which, for example, can be as a PID controller, a multiplier 19, 19', 19", 19'" for multiplying the respective correction factor K, $K_a$, $K_b$, $K_c$ by the corresponding initial value of the respective model parameter $R_{hyd}$, J, $L_{hyd}$, $c_t$, and optionally a correction factor limitation 18, 18', 18", 18'". The operation of each parameter controller 12, 12', 12", 12'" is as previously described with respect to the first embodiment.

In principle, each individual correction signal can be used for the updating of a model parameter. However, it should be noted that signals which represent an active part, i.e. signals which are in phase with the excitation of the pump rotational speed—i.e. the sine signals in the case of sinusoidal excitation—adapt those model parameters which predominantly act on the active power. This is the case with the hydraulic resistance $R_{hyd}$ and the model parameter $c_t$, which is why, for these model parameters, the correction signals $T_{D1sin}$ and $P_{D1sin}$ are fed to the parameter controllers 12, 12" in FIGS. 5 and 8. However, it does not matter which of these parameter controllers 12, 12'" receives the correction signal $T_{D1sin}$ and which receives the correction signal $P_{D1sin}$. Insofar, the correction signal feed can be interchanged.

In contrast, those correction signals which represent reactive power, i.e. which are 90° phase-shifted to the excitation of the pump rotational speed, in other words the previously mentioned correction signals $T_{D1cos}$ and $P_{D1cos}$, should adapt such model parameters which predominantly influence the reactive power. This is the case with the mass inertia J and the hydraulic inductance $L_{hyd}$, which is why, for these model parameters, the correction signals $T_{D1cos}$ and $P_{D1cos}$ are fed to the parameter controllers 12', 12" in FIGS. 6 and 7. Again, it does not matter which of these parameter controllers 12', 12" receives the correction signal $T_{D1cos}$ and which receives the correction signal $P_{D1cos}$. Insofar, the correction signal feed can be interchanged.

Experiments have shown that the following assignment of the correction signals $T_{D1sin}$, $T_{D1cos}$, $P_{D1sin}$, $P_{D1cos}$, $T_{D0}$, $P_{D0}$ to the model parameters is advantageous:

$T_{D1sin}$ to adapt the model parameter $R_{hyd}$
$T_{D1cos}$ to adapt the model parameter $L_{hyd}$
$P_{D1sin}$ to adapt the model parameter $c_t$
$P_{D1cos}$ to adapt the model parameter J
$T_{D0}$ to adapt the model parameter $v_s$
$P_{D0}$ to adapt the model parameter $v_i$ However, other combinations are also possible. According to this assignment, the individual correction signals can be fed to that single parameter controller 12.1, 12.2, etc. which adapts the correspondingly assigned model parameter.

Figure 14:
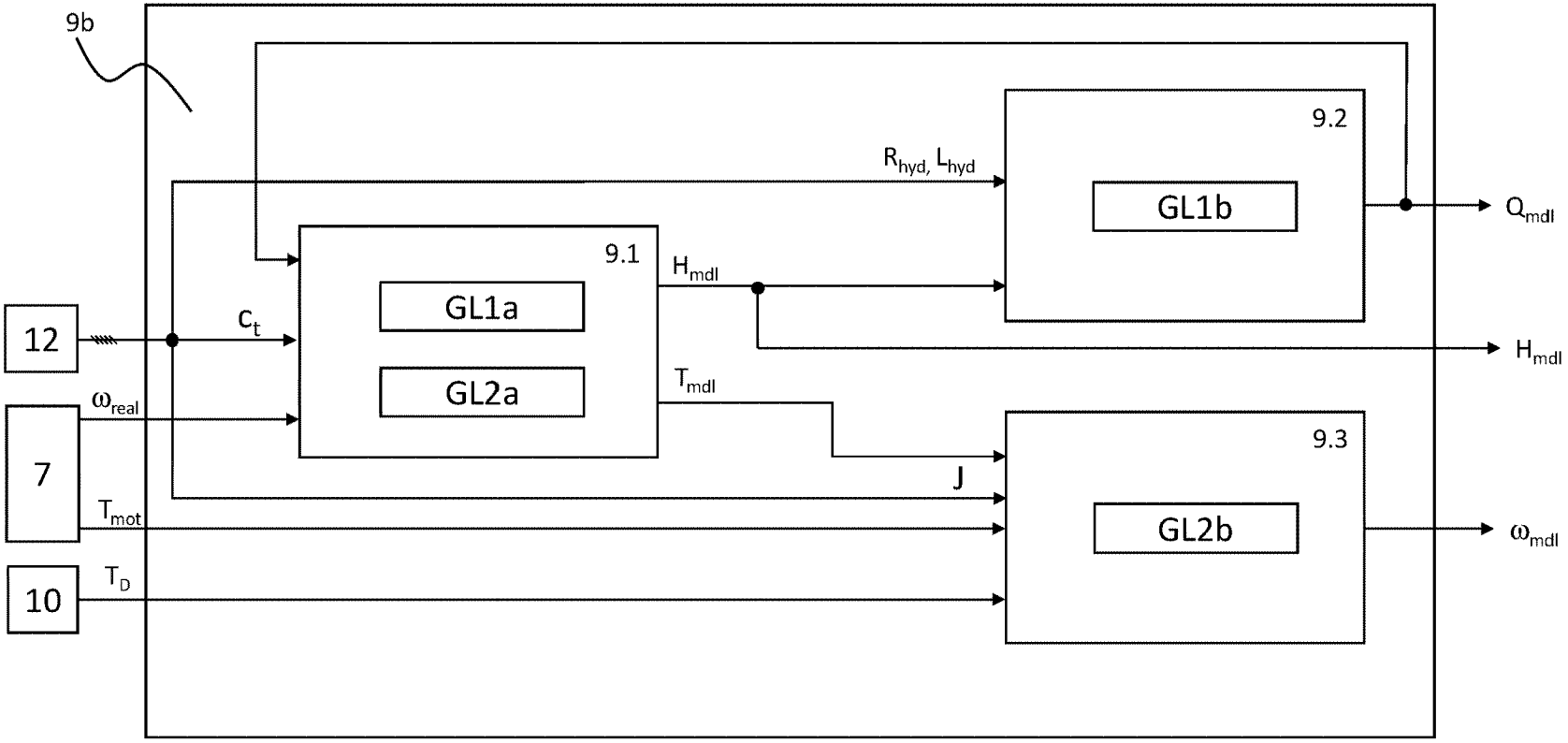
FIG. 14 is a signal flow diagram showing an embodiment of the pump-motor model 9*b* in FIGS. 11 and 12 with multi-model parameter adaptation.

The output signals of the single parameter controllers 12.1, 12.2, etc., i.e. the adapted model parameters, are then made available to the pump-motor model 9*b*, whose signal flow diagram FIG. 14 shows. The pump-motor model 9*b* can then use these new values of the model parameters to calculate the model rotational speed $\omega_{mod}$, the delivery flow rate $Q_{mdl}$ and the delivery head $H_{mdl}$. For this purpose, the model parameter $c_t$ is fed to the first function block 9.1, the two model parameters $R_{hyd}$ and $L_{hyd}$ are fed to the second function block 9.2 and the model parameter J is fed to the third function block 9.3, within each of which the new model parameter values are then used in the corresponding partial equations Eq1b, Eq2a, Eq2b.

It should be noted that the above description is given by way of example only for purposes of illustration and in no way limits the scope of protection of the invention. Features of the invention indicated as "may," "exemplary," "preferred," "optional," "ideal," "advantageous," "optionally," "suitable" or the like are to be regarded as purely optional and likewise do not limit the scope of protection that is defined exclusively by the claims. To the extent that the above description recites elements, components, process steps, values or information having known, obvious or foreseeable equivalents, such equivalents are embraced by the invention. Likewise, the invention includes any changes, variations or modifications to embodiments that involve the substitution, addition, alteration or omission of elements, components, process steps, values or information, so long as the basic idea of the invention is maintained, regardless of whether the change, variation or modification results in an improvement or deterioration of an embodiment.

Although the above description of the invention mentions a plurality of physical, non-physical or procedural features in relation to one or more specific example of the invention, these features may also be used in isolation from the specific example of the invention, at least to the extent that they do not require the mandatory presence of further features. Conversely, these features mentioned in relation to one or more specific embodiment may be combined with each other and with further disclosed or non-disclosed features of shown or non-shown embodiments as desired, at least to the extent that the features are not mutually exclusive or do not lead to technical incompatibilities.

The invention claimed is:

1. A method of determining the delivery flow rate and/or the delivery head of a speed-controlled centrifugal pump assembly arranged in a hydraulic pipeline network, the method comprising the steps of:

a. operating the centrifugal pump assembly in the hydraulic pipeline network at a reference rotational speed or a torque, b. periodically exciting, by a control electronics, the hydraulic pipeline network by applying a periodic excitation signal of a specific excitation frequency to the reference rotational speed or to the torque to obtain a modulated torque or a modulated setpoint rotational speed, thereby modulating the actual rotational speed of the centrifugal pump assembly, c. setting, by the control electronics, the modulated torque or determining and setting a torque required to achieve the modulated setpoint rotational speed, d. determining, by the control electronics, the actual rotational speed of the centrifugal pump assembly, e. calculating, by the control electronics, a model rotational speed with the aid of a mathematical pump-motor model simulating the behavior of the centrifugal pump assembly within the hydraulic pipeline network, f. calculating, by the control electronics, at least one disturbance signal from a deviation of the model rotational speed from the actual rotational speed of the centrifugal pump assembly, g. determining, by the control electronics, at least one correction signal by integrating the product of the disturbance signal and a sine or cosine signal with the single or a multiple of the excitation frequency over at least one period of the excitation signal, h. adapting, by the control electronics, at least one model parameter of the pump-motor model as a function of the correction signal, i. calculating, by the control electronics, the delivery flow rate and/or the delivery head using the adapted pump-motor model, and j. setting, by the control electronics, the delivery head as a function of the delivery flow rate.

2. The method according to claim 1, wherein the pump-motor model comprises at least a first equation in integral form for calculating the delivery flow rate and a second equation in integral form for calculating the model rotational speed, and these two equations are repeatedly cyclically evaluated.

3. The method of claim 2, wherein the first equation is used in the following integral form:

$$Q_{mdl} = \frac{1}{L_{hyd}} \int_0^{\tau} \left( \left( a\omega^2 - bQ_{mdl}\omega - cQ_{mdl}^2 \right) - R_{hyd}Q_{mdl}^2 - H_{static} \right) dt \quad \text{Eq1}$$

or $$Q_{mdl}(k+1) = Q_{mdl}(k) + \frac{1}{L_{hyd}} \left( \left( a\omega^2(k) - bQ_{mdl}(k)\omega(k) - cQ_{mdl}^2(k) \right) - R_{hyd}Q_{mdl}^2(k) - H_{static}(k) \right) \cdot \Delta t \quad \text{Eq1}$$

where $Q_{mdl}$ is the delivery flow rate of the centrifugal pump assembly,

ω a is a rotational speed or rotational frequency of the centrifugal pump assembly, a, b, c are parameters that describe the hydraulic pump performance characteristics by means of pump curves, $R_{hyd}$ is the hydraulic resistance of the hydraulic pipeline network, $L_{hyd}$ is the hydraulic inductance of the hydraulic pipeline network, $H_{static}$ is a geodetic head, k is a discrete point of time and Δt is the time interval between one point of time k and the next point of time k+1.

4. The method according to claim 2 wherein the first equation is used in the form of the following two partial equations that are calculated repeatedly one after the other:

$$H_{mdl} = a\omega^2 - bQ_{mdl}\omega - cQ_{mdl}^2 \quad \text{Eq1a}$$

$$Q_{mdl} = \frac{1}{L_{hyd}} \int_0^{\tau} \left( H_{mdl} - R_{hyd}Q_{mdl}^2 - H_{static} \right) dt \text{ or} \quad \text{Eq1b}$$

$$H_{mdl}(k) = a\omega^2(k) - bQ_{mdl}(k)\omega(k) - cQ_{mdl}^2(k) \quad \text{Eq1a}$$

$$Q_{mdl}(k+1) = Q_{mdl}(k) + \frac{1}{L_{hyd}} \left( H_{mdl}(k) - R_{hyd}Q_{mdl}^2(k) - H_{static}(k) \right) \cdot \Delta t \quad \text{Eq1b}$$

where $H_{mdl}$ is the delivery head of the centrifugal pump assembly, $Q_{mdl}$ is the delivery flow rate of the centrifugal pump assembly, ω is a rotational speed or rotational frequency of the centrifugal pump assembly, a, b, c are parameters that describe the hydraulic pump performance characteristics by means of pump curves, $R_{hyd}$ is the hydraulic resistance of the hydraulic pipeline network, $L_{hyd}$ is the hydraulic inductance of the hydraulic pipeline network, $H_{static}$ is a geodetic head, k is a discrete point of time and Δt is the time interval between one point of time k and the next point of time k+1.

5. The method according to claim 2, wherein the second equation is used in the following integral form:

$$\omega_{mdl} = \frac{1}{J}\int_0^t\left(T_{mot} - \left(a_t Q_{mdl}\omega - b_t Q_{mdl}^2 - c_t\frac{Q_{mdl}^3}{\omega} + v_i\omega^2 + v_s\omega - I\frac{dQ}{dt}\right) + T_D\right)dt \text{ or} \quad \text{Eq2}$$

$$\omega_{mdl}(k+1) = \omega_{mdl}(k) + \frac{1}{J}\left(T_{mot}(k) - \left(a_t Q_{mdl}(k)\omega(k) - b_t Q_{mdl}^2(k) - c_t\frac{Q_{mdl}^3(k)}{\omega(k)} + v_i\omega^2(k) + v_s\omega(k) - I\frac{Q(k)-Q(k-1)}{\Delta t}\right) + T_D(k)\right)\cdot\Delta t \quad \text{Eq2}$$

where $T_{mot}$ is the mechanical torque of a motor of the centrifugal pump assembly, $T_D$ is the calculated disturbance signal in the form of a moment, $Q_{mdl}$ is the delivery flow rate of the centrifugal pump assembly, $\omega_{mdl}$ is the model rotational speed or rotational frequency of the centrifugal pump assembly, $\omega$ is a rotational speed or rotational frequency of the centrifugal pump assembly, $a_t$, $b_t$, $c_t$ are parameters describing the static torque performance characteristics of the centrifugal pump assembly by means of torque curves, $v_i$ is a quantity describing a friction between an impeller of the centrifugal pump assembly and a medium pumped by the centrifugal pump assembly, $v_s$ is a quantity describing friction in bearings of the centrifugal pump assembly, J is the mass inertia of rotating components of the centrifugal pump assembly, I is the mass inertia of the pumped medium in the impeller, k is a discrete point of time and $\Delta t$ is the time interval between one point of time k and the next point of time k+1.

6. The method according to claim 2 wherein the second equation is used in the form of the following two partial equations that are calculated successively, cyclically repeated:

$$T_{mdl} = a_t Q_{mdl}\omega - b_t Q_{mdl}^2 - c_t\frac{Q_{mdl}^3}{\omega} + v_i\omega^2 + v_s\omega - I\frac{dQ}{dt} \quad \text{Eq2a}$$

$$\omega_{mdl} = \frac{1}{J}\int_0^t (T_{mot} - T_{mdl} + T_D)dt \text{ or} \quad \text{Eq2b}$$

$$T_{mdl}(k) = a_t Q_{mdl}(k)\omega(k) - b_t Q_{mdl}^2(k) - c_t\frac{Q_{mdl}^3(k)}{\omega(k)} + v_i\omega^2(k) + v_s\omega(k) - I\frac{Q(k)-Q(k-1)}{\Delta t} \quad \text{Eq2a}$$

$$\omega_{mdl}(k+1) = \omega_{mdl}(k) + \frac{1}{J}(T_{mot}(k) - T_{mdl}(k) + T_D(k))\cdot\Delta t \quad \text{Eq2b}$$

where $T_{mdl}$ is a pump torque of the centrifugal pump assembly, $T_{mot}$ is the mechanical torque of a motor of the centrifugal pump assembly, $T_D$ is the calculated disturbance signal in the form of a moment, $Q_{mdl}$ is the delivery flow rate of the centrifugal pump assembly, $\omega_{mdl}$ is the model rotational speed or rotational frequency of the centrifugal pump assembly, $\omega$ is a rotational speed or rotational frequency of the centrifugal pump assembly, $a_t$, $b_t$, $c_t$ are parameters describing the static torque performance characteristics of the centrifugal pump assembly by means of torque curves, $v_i$ is a quantity describing friction between an impeller of the centrifugal pump assembly and a medium pumped by the centrifugal pump assembly, $v_s$ is a quantity describing friction in bearings of the centrifugal pump assembly, J is the mass inertia of rotating components of the centrifugal pump assembly, I is the mass inertia of the pumped medium in the impeller, k is a discrete point of time and $\Delta t$ is the time interval between one point of time k and the next point of time k+1.

7. The method according to claim 5 or 6, wherein the at least one model parameter is the parameter $c_t$, and in step g the sine or cosine signal is in phase with the excitation signal.

8. The method according to claim 5 or 6 wherein the model parameter is the parameter $c_t$, and in step g the sine or cosine signal is in phase with the excitation signal, and in step fa first disturbance signal and a second disturbance signal are determined by supplying the difference between the model rotational speed and the actual rotational speed to a controller containing at least one integral component, and an output signal of this controller forms the first disturbance signal and the second disturbance signal is formed by multiplying the output signal of this controller by the actual rotational speed, and wherein the parameter $c_t$ is adjusted in dependence of a first correction signal formed from the first disturbance signal.

9. The method according to claim 1, wherein in step f:

a. the difference between the model rotational speed and the actual rotational speed is fed to a controller containing at least one integral component, an output signal of this controller forming the disturbance signal or the disturbance signal being formed by multiplying the output signal of this controller by the actual rotational speed.

10. The method according to claim 1, wherein in step f. a first disturbance signal and a second disturbance signal are determined by supplying the difference between the model rotational speed and the actual rotational speed to a controller containing at least one integral component, and an output signal of this controller forms the first disturbance signal and the second disturbance signal is formed by multiplying the output signal of this controller by the actual rotational speed.

11. The method according to claim 10, wherein the model parameter is the hydraulic resistance of the hydraulic pipeline network, and in step g. the sine or cosine signal is in phase with the excitation signal, and the hydraulic resistance is adjusted in dependence of a first correction signal formed from the second disturbance signal.

12. The method according to claim 10, wherein the model parameter is the mass inertia of the centrifugal pump assembly or the hydraulic inductance of the pipeline network and in step g. the sine or cosine signal is phase-shifted 90° to the excitation signal and wherein the mass inertia of the centrifugal pump assembly is adjusted in dependence of a second correction signal formed from the second disturbance signal, and/or the hydraulic inductance of the pipeline network is adjusted in dependence of a second correction signal formed from the first disturbance signal.

13. The method according to claim 1, wherein two or more correction signals are determined from the disturbance signal or from each of the disturbance signals, and each correction signal is used to adapt in each case a specific model parameter of the pump-motor model.

14. The method according to claim 1, wherein the model parameter is the hydraulic resistance of the pipeline network, and in step g. the sine or cosine signal is in phase with the excitation signal.

15. The method according to claim 1, wherein the model parameter is the mass inertia of the centrifugal pump assembly or the hydraulic inductance of the pipeline network and in step g. the sine or cosine signal is phase-shifted 90° to the excitation signal.

16. The method according to claim 1, further comprising the step of adapting the model parameter by means of a controller containing an integral component by:

supplying the correction signal to the controller; and multiplying an output signal of the controller with an initial value for the model parameter to obtain the adapted model parameter.

17. A centrifugal pump assembly having a centrifugal pump, an electric motor driving it and control electronics for controlling the electric motor with or without feedback, wherein the control electronics is adapted to perform the method according to claim 1.

18. A system comprising:

a centrifugal pump;

a motor adapted to drive the centrifugal pump; and a control electronics adapted to perform operations comprising:

a. operating the centrifugal pump assembly in a hydraulic pipeline network at a reference rotational speed or a torque;

b. periodically exciting the hydraulic pipeline network by applying a periodic excitation signal of a specific excitation frequency to the reference rotational speed or to the torque to obtain a modulated torque or a modulated setpoint rotational speed, thereby modulating the actual rotational speed of the centrifugal pump assembly;

c. setting the modulated torque or determining and setting a torque required to achieve the modulated setpoint rotational speed, d. determining the actual rotational speed of the centrifugal pump assembly;

e. calculating a model rotational speed with the aid of a mathematical pump-motor model simulating the behavior of the centrifugal pump assembly within the hydraulic pipeline network;

f. calculating at least one disturbance signal from a deviation of the model rotational speed from the actual rotational speed of the centrifugal pump assembly;

g. determining at least one correction signal by integrating the product of the disturbance signal and a sine or cosine signal with the single or a multiple of the excitation frequency over at least one period of the excitation signal;

h. adapting at least one model parameter of the pump-motor model as a function of the correction signal;

i. calculating the delivery flow rate and/or the delivery head using the adapted pump-motor model; and j. setting the delivery head as a function of the delivery flow rate.

19. The system of claim 18, wherein the operations further comprise:

determining that the correction signal falls below a predetermined limit value; and in response to determining that the correction signal falls below the predetermined limit value: issuing one of an error message, a warning, or a maintenance notice based on the correction signal.

20. The system of claim 18, wherein the operations further comprise:

detecting a condition of the centrifugal pump assembly based on a plurality of adjustments of the at least one model parameter over a period of time; and determining a maintenance requirement of the centrifugal pump assembly based on the determined condition.

* * * * *